US007758139B2

(12) United States Patent
Yoshida et al.

(10) Patent No.: US 7,758,139 B2
(45) Date of Patent: Jul. 20, 2010

(54) LIQUID EJECTING APPARATUS AND TRANSPORT METHOD

(75) Inventors: Masahiko Yoshida, Shiojiri (JP); Michiaki Tokunaga, Matsamoto (JP); Takeshi Yoshida, Shiojiri (JP); Tatsuya Nakano, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 12/286,238

(22) Filed: Sep. 29, 2008

(65) Prior Publication Data

US 2009/0122108 A1 May 14, 2009

(30) Foreign Application Priority Data

Sep. 27, 2007 (JP) ..... 2007-252317

(51) Int. Cl.
*B41J 25/308* (2006.01)

(52) U.S. Cl. ..... 347/8; 347/101; 347/104
(58) Field of Classification Search ..... 347/8
See application file for complete search history.

(56) References Cited

U.S. PATENT DOCUMENTS 6,101,426 A * 8/2000 Kimura et al. ..... 700/219
6,955,413 B2 * 10/2005 Kohno et al. ..... 347/19

FOREIGN PATENT DOCUMENTS

JP 05-096796 4/1993

* cited by examiner

*Primary Examiner*—Matthew Luu
*Assistant Examiner*—Brian J Goldberg
(74) *Attorney, Agent, or Firm*—Nutter McClennen & Fish LLP; John J. Penny, Jr.

(57) ABSTRACT

A liquid ejecting apparatus has a head, a transport mechanism, a memory, and a controller. The head ejects a liquid. The transport mechanism transports a medium in a transport direction with respect to the head in accordance with a target transport amount that is targeted. The memory stores a plurality of correction values, each of the correction values being associated with a relative position between the head and the medium, a range of the relative position to which that correction value is to be applied being associated with that correction value. In the case where a transport using the target transport amount is performed beyond the range of the relative position associated with the correction value that is associated with the relative position before the transport, the controller corrects the target transport amount based on the correction value associated with the relative position before the transport and the correction value associated with the relative position after the transport.

4 Claims, 26 Drawing Sheets

| CORRECTION VALUE | BORDER POSITION INFORMATION |
|---|---|
| Ca(1) | THEORETICAL POSITION CORRESPONDING TO L2 |
| Ca(2) | THEORETICAL POSITION CORRESPONDING TO L3 |
| Ca(3) | THEORETICAL POSITION CORRESPONDING TO L4 |
| ⋮ | ⋮ |
| Ca(19) | THEORETICAL POSITION CORRESPONDING TO L20 |
| Cc | THEORETICAL POSITION CORRESPONDING TO La1 |
| Cb1 | THEORETICAL POSITION CORRESPONDING TO Lb1 |
| Cb2 | – |

FIG. 24

CORRECTION VALUES = Ca(i) × (F/L)

CORRECTION VALUES = Cb1 × (F/L2)

CORRECTION VALUES = Ca(i) × (F1/L) + Ca(i+1) × (F2/L)

CORRECTION VALUES =Cc × (F1/L3) + Cb1 × (F2/L2)

CORRECTION VALUES = Cb1 × (F/L2) + Cb2 × (F2/L4)
HERE L4 = 1 INCH

CORRECTION VALUES
= Ca(i) × (F1/L) + Ca(i+1) + Ca(i+2) × (F2/L)

CORRECTION VALUES
= Cc × (F1/L3) + Cb1+Cb2 × (F2/L4)
HERE L4 = 1 INCH

LIQUID EJECTING APPARATUS AND TRANSPORT METHOD

CROSS-REFERENCE TO RELATED APPLICATIONS

The present application claims priority from Japanese Patent Application No. 2007-252317 filed on Sep. 27, 2007, which is herein incorporated by reference

BACKGROUND

1. Technical Field

The present invention relates to liquid ejecting apparatuses and transport methods.

2. Related Art

Inkjet printers are known as liquid ejecting apparatuses in which a medium (such as paper or cloth for example) is transported in a transport direction and a liquid is ejected onto the medium by a head. When a transport error occurs while transporting the medium in a liquid ejecting apparatus such as this, the head becomes unable to eject the liquid at a correct position on the medium. In particular, with inkjet printers, when ink droplets do not land in the correct positions on the medium, there is a risk that white streaks or black streaks will occur in the printed image and the picture quality will deteriorate.

Accordingly, methods have been proposed for correcting transport amounts of the medium. For example, JP-A-5-96796 proposes that a test pattern is printed, then the test pattern is read and correction values are calculated based on the reading result, so that in ejecting liquid the transport amounts are corrected based on the correction values.

In JP-A-5-96796, it is presumed that recording is to be carried out using fixed transport amounts. And in JP-A-5-96796, the correction values are each associated with a specific transport operation; when a certain transport operation is to be carried out, the correction values associated with that transport operation are applied as they are.

However, in the method of JP-A-5-96796, the transport amounts cannot be varied and there are many restrictions.

SUMMARY

An advantage of the invention is to enable the transport amounts to be corrected in a manner having few restrictions.

A primary aspect of the invention for achieving the above-described advantage is a liquid ejecting apparatus, including: a head that ejects a liquid; a transport mechanism that transports a medium in a transport direction with respect to the head in accordance with a target transport amount that is targeted; a memory that stores a plurality of correction values, each of the correction values being associated with a relative position between the head and the medium, a range of the relative position to which that correction value is to be applied being associated with that correction value; and a controller that, in the case where a transport using the target transport amount is performed beyond the range of the relative position associated with the correction value that is associated with the relative position before the transport, corrects the target transport amount based on the correction value associated with the relative position before the transport and the correction value associated with the relative position after the transport.

Other features of the invention will be made clear by reading the description of the present specification with reference to the accompanying drawings.

BRIEF DESCRIPTION OF THE DRAWINGS

For a more complete understanding of the invention and the advantages thereof, reference is now made to the following description taken in conjunction with the accompanying drawings wherein:

FIG. 24 is an explanatory diagram of a table stored in a memory 63.

DESCRIPTION OF EXEMPLARY EMBODIMENTS

Figure 1:
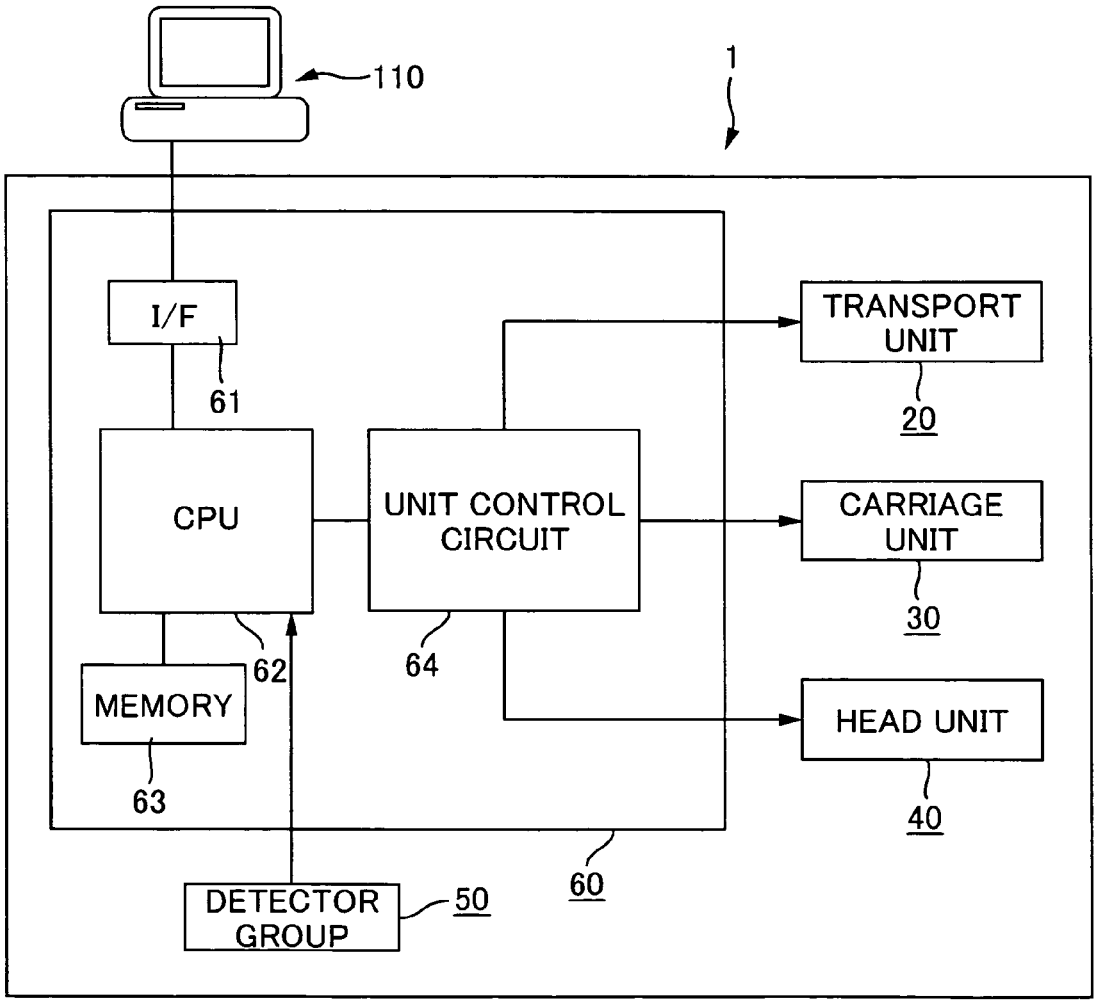
FIG. 1 is a block diagram of an overall configuration of a printer 1.

At least the following matters will be made clear by the explanation in the present specification and the description of the accompanying drawings.

A liquid ejecting apparatus, including: a head that ejects a liquid; a transport mechanism that transports a medium in a transport direction with respect to the head in accordance with a target transport amount that is targeted; a memory that stores a plurality of correction values, each of the correction values being associated with a relative position between the head and the medium, a range of the relative position to which that correction value is to be applied being associated with that correction value; and a controller that, in the case where a transport using the target transport amount is performed beyond the range of the relative position associated with the correction value that is associated with the relative position before the transport, corrects the target transport amount based on the correction value associated with the relative position before the transport and the correction value associated with the relative position after the transport.

With such a liquid ejection apparatus, transport amounts can be corrected in a manner having few restrictions.

Furthermore, the transport mechanism may have an upstream side transport roller and a downstream side transport roller that transport the medium, these being arranged on an upstream side and a downstream side respectively in the transport direction; the plurality of correction values may include a first correction value, the range of the relative position associated with the first correction value being a range in which the medium is transported by both the upstream side transport roller and the downstream side transport roller in the relative position that is at one end of the range, and the medium is transported by only the downstream side transport roller of these two rollers in the relative position that is at another end of the range; and in the case where a transport using the target transport amount is performed, the first correction value may be either one of the correction value associated with the relative position before the transport and the correction value associated with the relative position after the transport.

In this case, transport error whose magnitude becomes larger due to a transition from a so-called NIP state to a so-called non NIP state can be corrected accurately in accordance with the transport amounts.

Furthermore, the controller may correct the target transport amount by weighting to the correction value in accordance with a ratio of a range in which the relative position changes while transporting using the target transport amount to the range of the relative position to which the correction value is to be applied.

In this case, transport error that fluctuates in response to the relative position of the medium and the head can be corrected accurately in accordance with the transport amount.

Furthermore, a transport method, in which a target transport amount that is targeted is corrected based on correction values to transport a medium can also be achieved, the method including: storing in a memory in advance a plurality of correction values, each of the correction values being associated with a relative position between a head that ejects a liquid and the medium, in which a range of the relative position to which that correction value is to be applied is associated with that correction value; in the case where a transport using the target transport amount is performed beyond the range of the relative position associated with the correction value that is associated with the relative position before the transport, correcting the target transport amount based on the correction value associated with the relative position before the transport and the correction value associated with the relative position after the transport; and transporting the medium based on the corrected target transport amount.

With such a transport method, transport amounts can be corrected in a manner having few restrictions.

Configuration of Printer

Regarding Configuration of Inkjet Printer

Figure 2A:
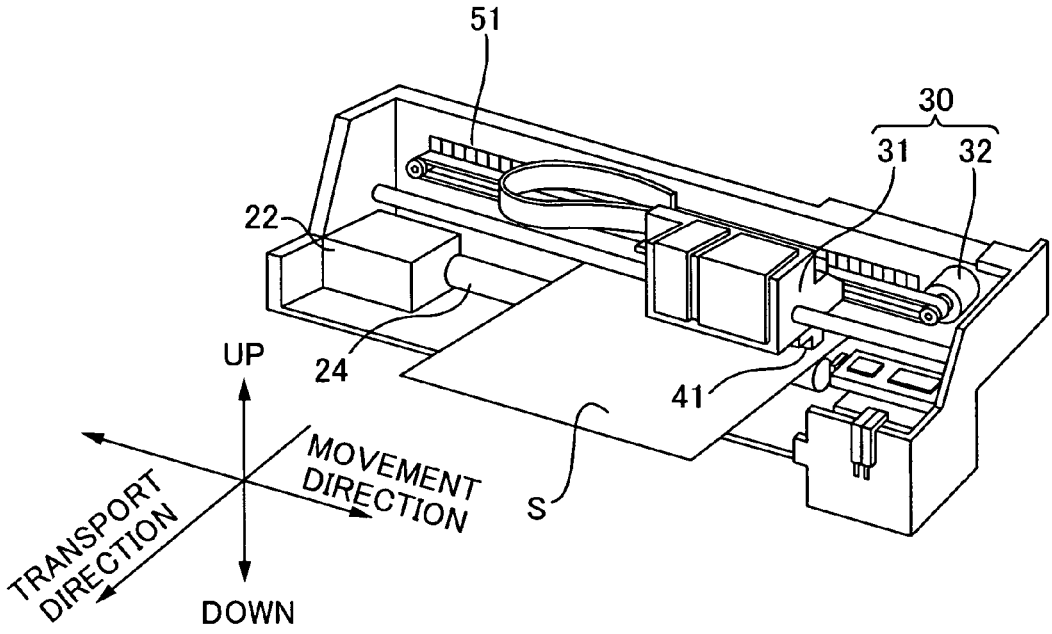
FIG. 2A is a schematic view of the overall configuration of the printer 1 and FIG. 2B is a cross-sectional view of the overall configuration of the printer 1.
Figure 2B:
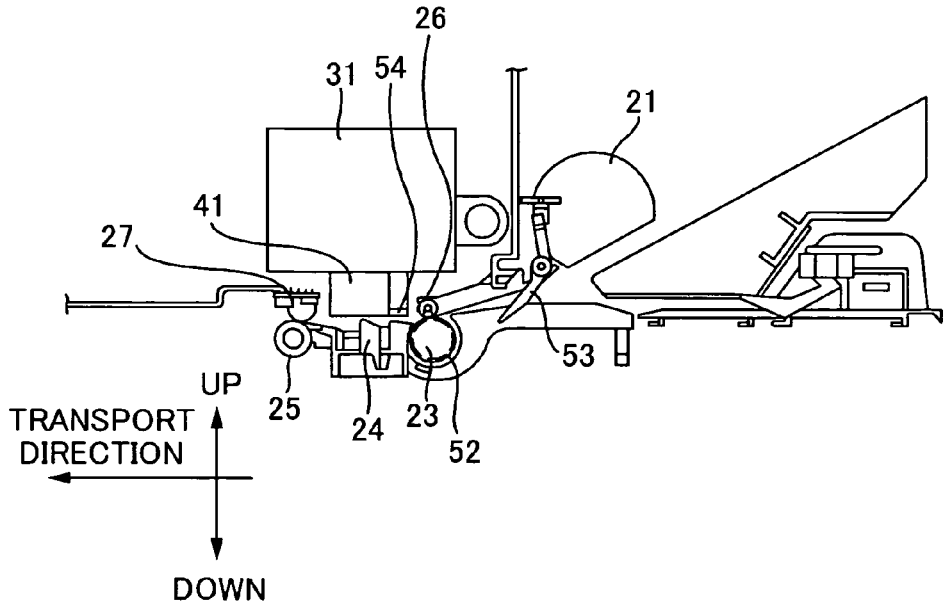

FIG. 1 is a block diagram of an overall configuration of a printer 1. FIG. 2A is a schematic view of the overall configuration of the printer 1. FIG. 2B is a cross-sectional view of the overall configuration of the printer 1. Hereinafter, the basic configuration of the printer is described.

The printer 1 includes a transport unit 20, a carriage unit 30, a head unit 40, a detector group 50, and a controller 60. The printer 1, upon having received print data from a computer 110, which is an external device, controls various units (the transport unit 20, the carriage unit 30, and the head unit 40) using the controller 60. The controller 60 controls the units based on the print data received from the computer 110, to print an image on paper. The detector group 50 monitors conditions within the printer 1, and outputs detection results to the controller 60. The controller 60 controls the units based on the detection results output from the detector group 50.

The transport unit 20 is for transporting a medium (such as paper S) in a predetermined direction (hereinafter referred to as a transport direction). The transport unit 20 includes a paper supply roller 21, a transport motor 22 (also referred to as a PF motor), a transport roller 23, which is one example of an upstream side transport roller, a platen 24, and discharge rollers 25, which is one example of a downstream side transport roller. The paper supply roller 21 is a roller for supplying paper that has been inserted into a paper insert opening into the printer. The transport roller 23 is a roller for transporting the paper S that has been supplied by the paper supply roller 21 up to a printable region, and is driven by the transport motor 22. The platen 24 supports the paper S that is being printed. The discharge rollers 25 are rollers for discharging the paper S out of the printer, and are provided on a downstream side, with respect to the transport direction, of the printable region. The discharge rollers 25 are rotated in synchronization with the transport roller 23.

It should be noted that when the transport roller 23 transports the paper S, the paper S is sandwiched between the transport roller 23 and driven rollers 26. This makes the posture of the paper S stable. On the other hand, when the discharge rollers 25 transport the paper S, the paper S is sandwiched between the discharge rollers 25 and driven rollers 27. The discharge rollers 25 are provided on a downstream side from the printable region in the transport direction and therefore the driven rollers 27 are configured so that its contact surface with the paper S is small (see FIG. 4). For this reason, when a lower end of the paper S passes the transport roller 23 and the paper S becomes transported by the discharge rollers 25 only, the posture of the paper S tends to become unstable, which also tends to make the transport characteristics fluctuate.

The carriage unit 30 is for making the head move (also referred to as "scan") in a predetermined direction (hereinafter, referred to as a movement direction). The carriage unit 30 includes a carriage 31 and a carriage motor 32 (also referred to as a CR motor) The carriage 31 can move in a reciprocating manner along the movement direction, and is driven by the carriage motor 32. Furthermore, the carriage 31 detachably retains an ink cartridge that contains ink.

The head unit 40 is for ejecting ink onto paper. The head unit 40 is provided with a head 41 including a plurality of nozzles. The head 41 is provided on the carriage 31 so that when the carriage 31 moves in the movement direction, the head 41 also moves in the movement direction. Then, dot lines (raster lines) are formed on the paper in the movement direction as a result of the head 41 intermittently ejecting ink while moving in the movement direction.

The detector group 50 includes a linear encoder 51, a rotary encoder 52, a paper detection sensor 53, and an optical sensor 54, for example. The linear encoder 51 detects a position of the carriage 31 in the movement direction. The rotary encoder 52 detects an amount of rotation of the transport roller 23. The paper detection sensor 53 detects a position of a leading end of the paper that is being supplied. The optical sensor 54 detects whether or not the paper is present, using a light-emitting section and a light-receiving section provided in the carriage 31. The optical sensor 54 can also detect the width of the paper by detecting positions of the end portions of the paper while being moved by the carriage 31. Furthermore, depending on the circumstances, the optical sensor 54 can also detect the leading end of the paper (an end portion on the downstream side with respect to the transport direction; also called an upper end) and a trailing end of the paper (an end portion on the upstream side with respect to the transport direction; also called the lower end).

The controller 60 is a control unit (controller) for controlling the printer. The controller 60 includes an interface section 61, a CPU 62, a memory 63, and a unit control circuit 64. The interface section 61 exchanges data between the computer 110, which is an external device, and the printer 1. The CPU 62 is a computer processing device for carrying out overall control of the printer. The memory 63 is for reserving a working region and a region for storing programs for the CPU 62, for instance, and has a memory device such as a RAM or an EEPROM. The CPU 62 controls each unit via the unit control circuit 64 according to programs stored in the memory 63.

Regarding Nozzles

Figure 3:
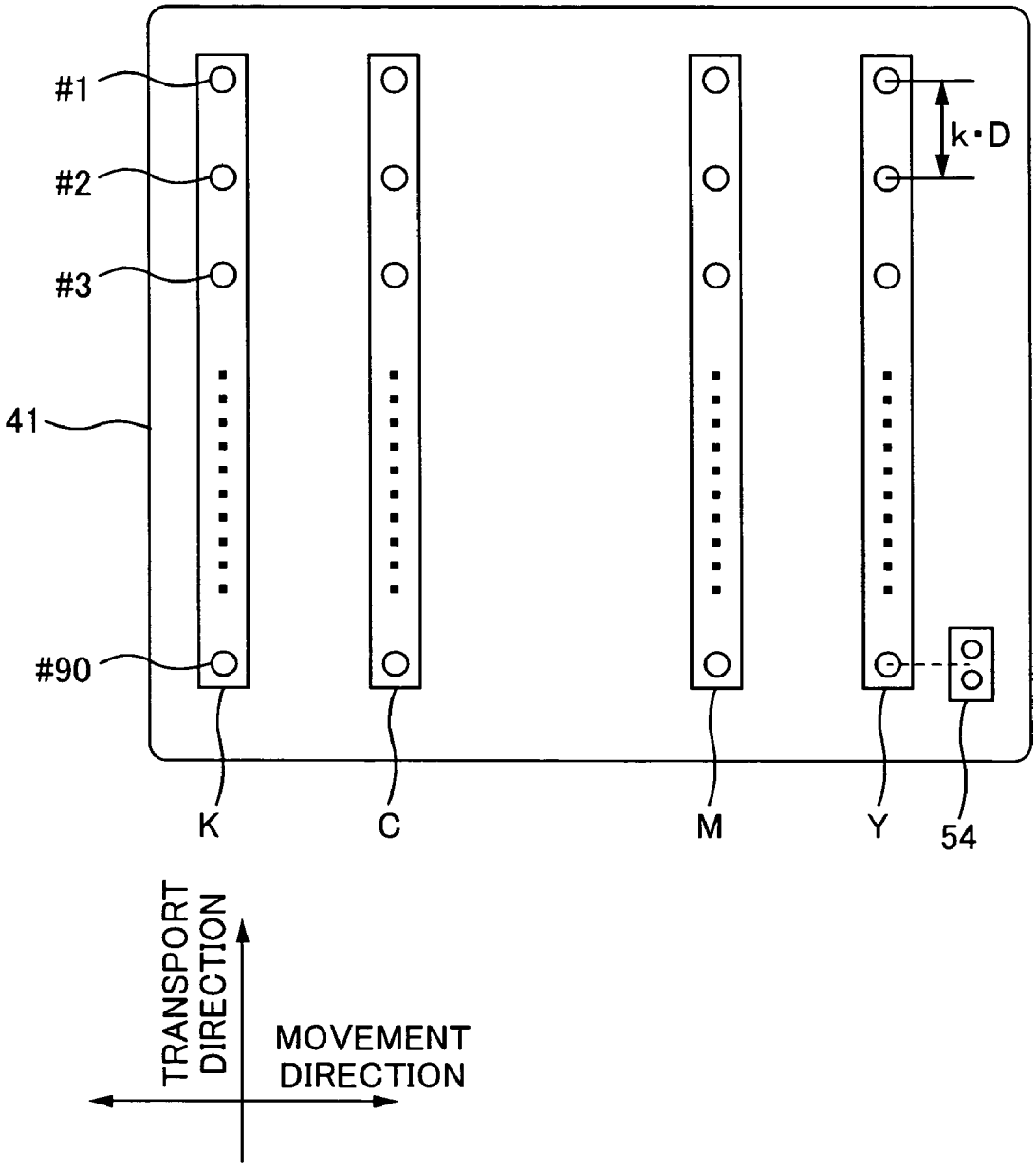
FIG. 3 is an explanatory diagram showing an arrangement of nozzles.

FIG. 3 is an explanatory diagram showing an arrangement of the nozzles at a lower face of the head 41. A black ink nozzle group K, a cyan ink nozzle group C, a magenta ink nozzle group M, and a yellow ink nozzle group Y are formed at the lower surface of the head 41. Each nozzle group is provided with 90 nozzles that are ejection openings for ejecting inks of various colors.

The plurality of nozzles of the nozzle groups are arranged in rows at a constant spacing (nozzle pitch: k·D) in the transport direction. Here D is the minimum dot pitch in the transport direction (that is, the spacing at the highest resolution of dots formed on the paper S). Also, k is an integer of 1 or more. For example, if the nozzle pitch is 90 dpi (1/90 inch) and the dot pitch in the transport direction is 720 dpi (1/720 inch), then k=8.

The nozzles of each of the nozzle groups are assigned a number (#1 through #90) that becomes smaller for nozzles further downstream. That is, the nozzle #1 is positioned further downstream in the transport direction than the nozzle #90. Also, the optical sensor 54 described above is provided substantially to the same position as the nozzle #90, which is on the side furthest upstream, as regards the position in the paper transport direction.

Each nozzle is provided with an ink chamber (not shown) and a piezo element. Driving the piezo element causes the ink chamber to expand and contract, thereby ejecting an ink droplet from the nozzle.

Transport Error

Regarding Paper Transport

Figure 4:
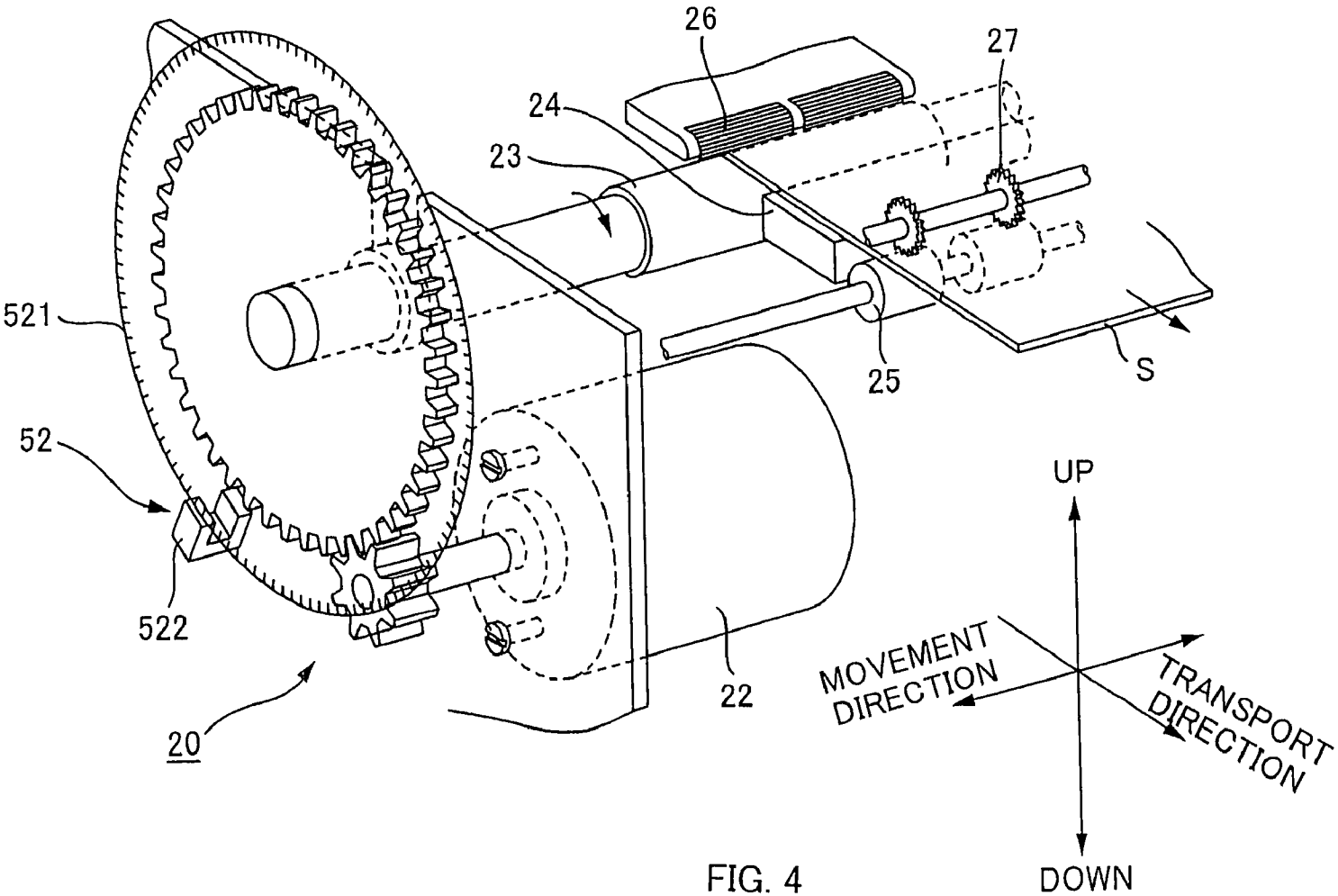
FIG. 4 is an explanatory diagram of a configuration of a transport unit 20.

FIG. 4 is an explanatory diagram of a configuration of the transport unit 20.

The transport unit 20 drives the transport motor 22 by a predetermined drive amount in accordance with a transport command from the controller 60. The transport motor 22 generates a drive force in the rotation direction that corresponds to the drive amount that has been commanded. The transport motor 22 then rotates the transport roller 23 using this drive force. That is, when the transport motor 22 generates a predetermined drive amount, the transport roller 23 is rotated by a predetermined rotation amount. When the transport roller 23 is rotated by the predetermined rotation amount, the paper is transported by a predetermined transport amount.

The amount that the paper is transported is determined according to the rotation amount of the transport roller 23. In the present embodiment, when the transport roller 23 performs a full rotation, the paper is transported by one inch (that is, the circumference of the transport roller 23 is one inch). Thus, when the transport roller 23 performs a ¼ rotation, the paper is transported by ¼ inch.

Consequently, if the rotation amount of the transport roller 23 can be detected, it is also possible to detect the transport amount of the paper. Accordingly, the rotary encoder 52 is provided in order to detect the rotation amount of the transport roller 23.

The rotary encoder 52 has a scale 521 and a detection section 522. The scale 521 has numerous slits provided at a predetermined spacing. The scale 521 is provided on the transport roller 23. That is, the scale 521 rotates together with the transport roller 23 when the transport roller 23 is rotated. Then, when the transport roller 23 rotates, each slit in the scale 521 successively passes through the detection section 522. The detection section 522 is provided in opposition to the scale 521, and is fastened on the main printer unit side. The rotary encoder 52 outputs a pulse signal each time a slit provided in the scale 521 passes through the detection section 522. Since the slits provided in the scale 521 successively pass through the detection section 522 according to the rotation amount of the transport roller 23, the rotation amount of the transport roller 23 is detected based on the output of the rotary encoder 52.

Then, when the paper is to be transported by a transport amount of one inch for example, the controller 60 drives the transport motor 22 until the rotary encoder 52 detects that the transport roller 23 has performed a full rotation. In this manner, the controller 60 drives the transport motor 22 until a rotation amount corresponding to a targeted transport amount (target transport amount) is detected by the rotary encoder 52, so that the paper is transported by the target transport amount.

Regarding Transport Error

In this regard, the rotary encoder 52 directly detects the rotation amount of the transport roller 23, and strictly speaking does not detect the transport amount of the paper S. For this reason, when the rotation amount of the transport roller 23 does not match the transport amount of the paper S, the rotary encoder 52 cannot accurately detect the transport amount of the paper S, resulting in transport error (detection error). There are two types of transport error, namely, DC component transport error and AC component transport error.

DC component transport error refers to a certain amount of transport error produced when the transport roller has performed a full rotation. DC component transport error can be considered to be caused by the circumference of the transport roller 23 being different in each individual printer due to deviation in production and the like. In other words, DC component transport error is a transport error that occurs because the design circumference of the transport roller 23 and the actual circumference of the transport roller 23 are different. DC component transport error is constant regardless of the commencement position when the transport roller 23 performs a full rotation. However, due to the effect of paper friction and the like, the actual DC component transport error is a value that varies depending on a total transport amount of the paper (this is discussed later). In other words, the actual DC component transport error is a value that varies depending on the relative positional relationship of the paper S and the transport roller 23 (or the paper S and the head 41).

AC component transport error refers to transport error corresponding to a location on a circumferential surface of the transport roller that is used during transport. AC component transport error varies in amount depending on the location on the circumferential surface of the transport roller that is used during transport. That is, AC component transport error is an amount that varies depending on the rotation position of the transport roller when transport commences and transport amount.

Figure 5:
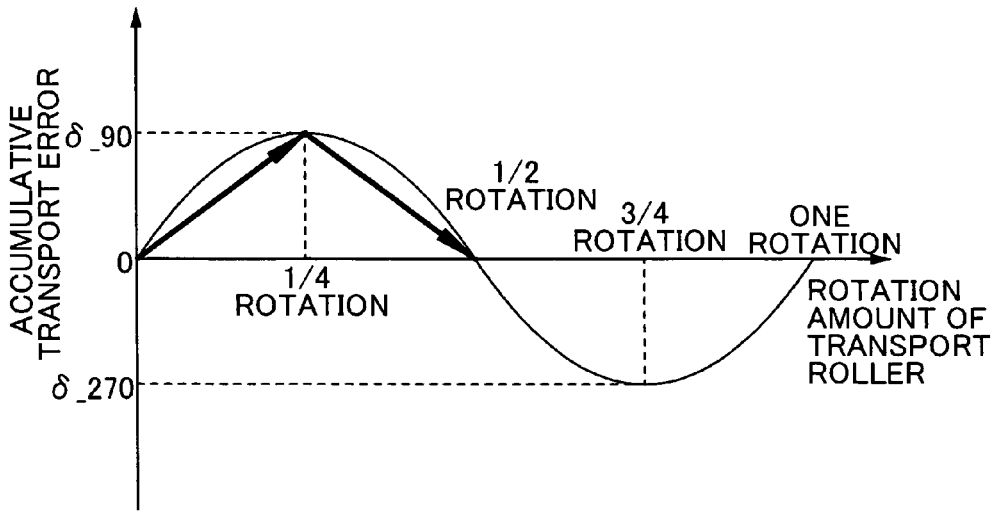
FIG. 5 is a graph for describing AC component transport error.

FIG. 5 is a graph for describing AC component transport error. The horizontal axis indicates the rotation amount of the transport roller 23 from a reference rotation position. The vertical axis indicates the transport error. When the graph is differentiated, the transport error produced when the transport roller performs transport at the corresponding rotation position is deduced. Here, the accumulative transport error at the reference position is set to zero and the DC component transport error is also set to zero.

When the transport roller 23 performs a ¼ rotation from the reference position, a transport error of δ_90 is produced, and the paper is transported by ¼ inch+δ_90. However, when the transport roller 23 performs a further ¼ rotation, a transport error of −δ_90 is produced, and the paper is transported by ¼ inch−δ_90.

The following three causes for example are conceivable as causes of AC component transport error.

First, influence due to the shape of the transport roller is conceivable. For example, when the transport roller is elliptical or egg shaped, the distance to the rotational center varies depending on the location on the circumferential surface of the transport roller. And when the medium is transported at an area where the distance to the rotational center is long, the transport amount increases with respect to the rotation amount of the transport roller. On the other hand, when the medium is transported at an area where the distance to the rotational center is short, the transport amount decreases with respect to the rotation amount of the transport roller.

Secondly, an eccentricity of the rotational axis of the transport roller is conceivable. In this case also, the length to the rotational center varies depending on the location on the circumferential surface of the transport roller. For this reason, even if the rotation amount of the transport roller is the same, the transport amount varies depending on the location on the circumferential surface of the transport roller.

Thirdly, inconsistency between the rotational axis of the transport roller and the center of the scale 521 of the rotary encoder 52 is conceivable. In this case, the scale 521 rotates eccentrically. As a result, the rotation amount of the transport roller 23 varies with respect to the detected pulse signals depending on the location of the scale 521 detected by the detection section 522. For example, when the detected location of the scale 521 is apart from the rotational axis of the transport roller 23, the rotation amount of the transport roller 23 becomes smaller with respect to the detected pulse signals, and therefore the transport amount becomes smaller. On the other hand, when the detected location of the scale 521 is close to the rotational axis of the transport roller 23, the rotation amount of the transport roller 23 becomes larger with respect to the detected pulse signals, and therefore the transport amount becomes larger.

As a result of these causes, the AC component transport error substantially forms a sine curve as shown in FIG. 5.

Transport Error Corrected by the Present Embodiment

Figure 6:
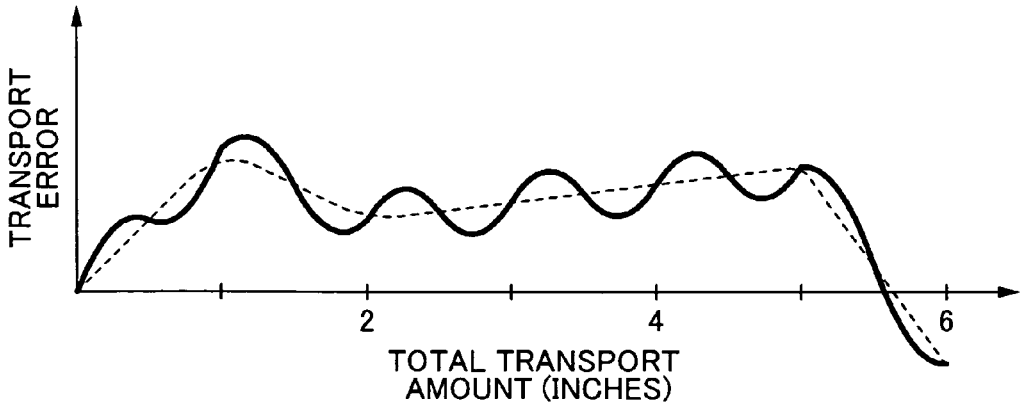
FIG. 6 is a graph (conceptual diagram) of transport error produced when transporting paper.

FIG. 6 is a graph (conceptual diagram) of the transport error produced when transporting paper of a size 101.6 mm×152.4 mm (4×6 inches). The horizontal axis in the graph indicates a total transport amount of the paper. The vertical axis in the graph indicates the transport error. The dashed line in FIG. 6 is a graph of DC component transport error. The AC component transport error is obtainable by subtracting the dashed line values (DC component transport error) in FIG. 6 from the solid line values (total transport error) in FIG. 6. Regardless of the total transport amount of the paper, the AC component transport error forms substantially a sine curve. On the other hand, due to the effect of paper friction and the like, the DC component transport error indicated by the dashed line is a value that varies depending on the total transport amount of the paper.

As has been described, the AC component transport error varies depending on the location on the circumferential surface of the transport roller 23. For this reason, even when transporting the same paper, the AC component transport error will vary if the rotation positions on the transport roller 23 at the commencement of transport are different, and therefore the total transport error (transport error indicated by the solid line on the graph) will vary. In contrast to this, unlike the AC component transport error, the DC component transport error has no relation to the location on the circumferential surface of the transport roller, and therefore even if the rotation position of the transport roller 23 varies at the commencement of transport, the transport error (DC component transport error) produced when the transport roller 23 has performed a full rotation is the same.

Furthermore, when attempting to correct the AC component transport error, it is necessary for the controller 60 to detect the rotation position of the transport roller 23. However, to detect the rotation position of the transport roller 23 it is necessary to further prepare an origin sensor for the rotary encoder 52, which results in increased costs.

Consequently, in the transport amount corrections according to the present embodiment shown below, the DC component transport error is corrected.

On the other hand, the DC component transport error is a value that varies (see the dashed line in FIG. 6) depending on the total transport amount of the paper (in other words, the relative positional relationship of the paper S and the transport roller 23). For this reason, if a greater number of correction values can be prepared corresponding to transport direction positions, fine corrections of the transport error can be achieved. Consequently, in the present embodiment, correction values for correcting the DC component transport error are prepared for each ¼ inch range rather than for each one inch range that corresponds to a full rotation of the transport roller 23.

Outline Description

Figure 7:
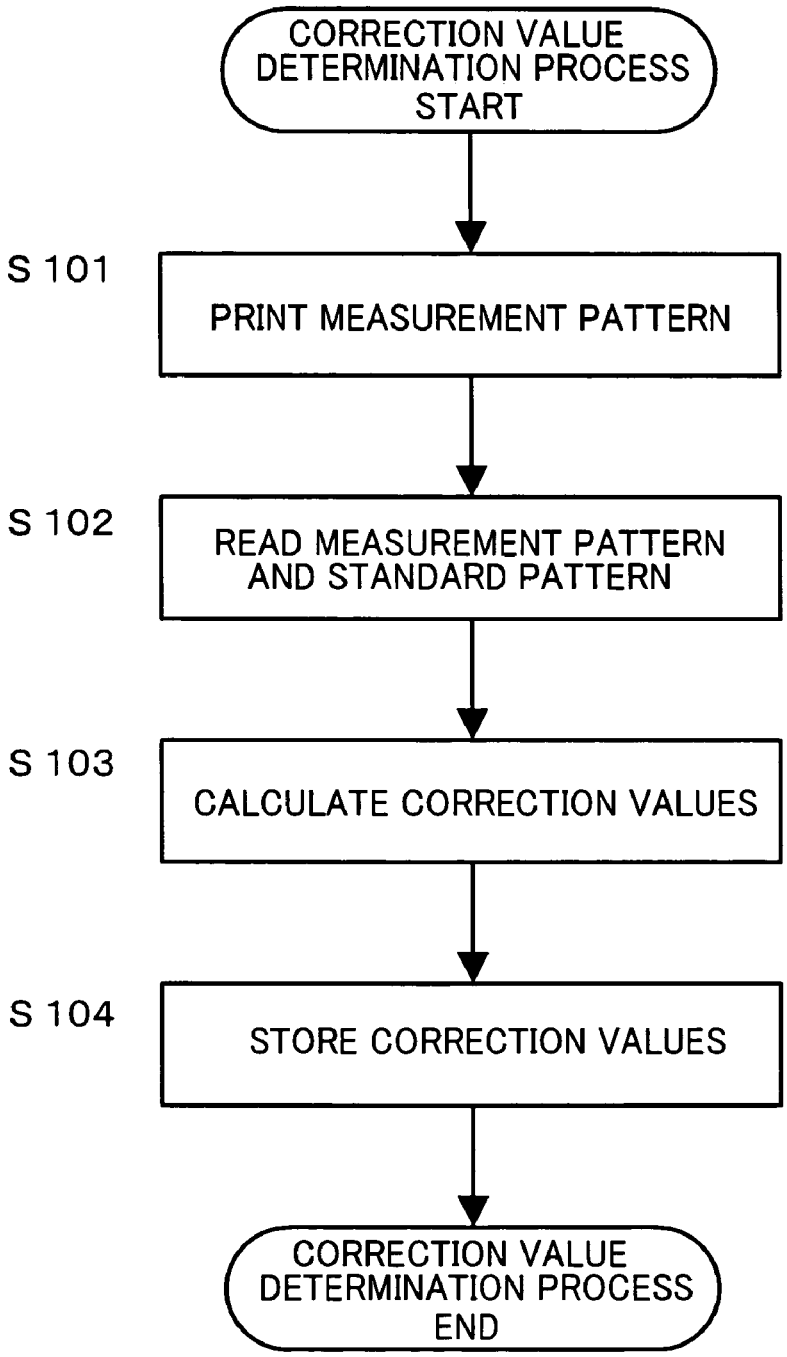
FIG. 7 is a flowchart showing up to determining the correction values for correcting transport amounts.
Figure 8A:
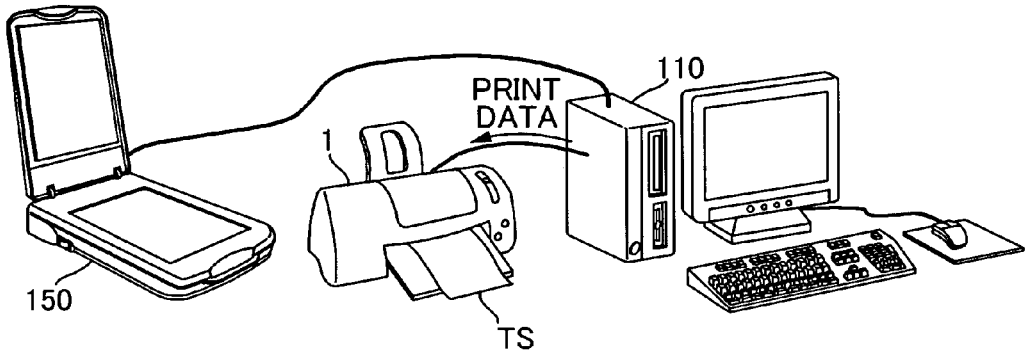
FIGS. 8A to 8C are explanatory diagrams of conditions up to determining the correction values.
Figure 8B:
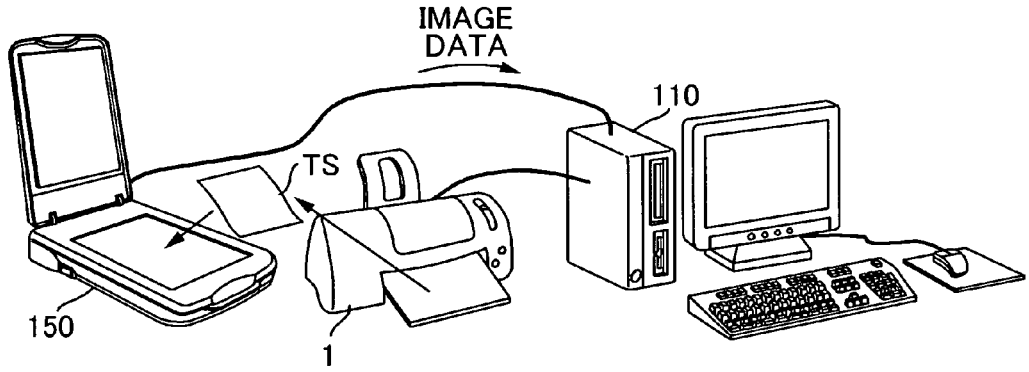
Figure 8C:
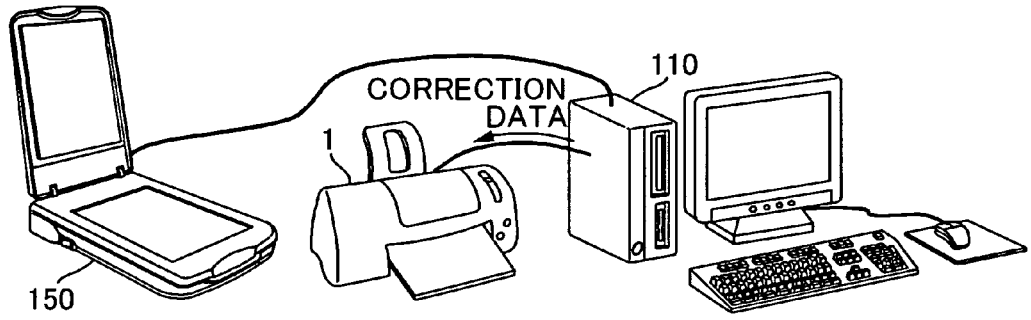

FIG. 7 is a flowchart showing up to determining the correction values for correcting transport amounts. FIGS. 8A to 8C are explanatory diagrams of conditions up to determining correction values. These processes are carried out in an inspection process at a printer manufacturing factory. Prior to this process, an inspector connects the printer 1 that is fully assembled to the computer 110 at the factory. The computer 110 at the factory is connected to a scanner 150 and is preinstalled with a printer driver, a scanner driver, and a program for obtaining correction values.

First, the printer driver sends print data to the printer 1 and the printer 1 prints a measurement pattern on a test sheet TS (S101, FIG. 8A). Next, the inspector sets the test sheet TS in the scanner 150 and the scanner driver causes the measurement pattern to be read by the scanner 150 so that image data is obtained (S102, FIG. 8B). It should be noted that a standard sheet is set in the scanner 150 along with the test sheet TS, and a standard pattern drawn on the standard sheet is also read together.

Then, the program for obtaining correction values analyzes the image data that has been read and calculates correction values (S103). Then the program for obtaining correction values sends the correction data to the printer 1 and the correction values are stored in the memory 63 of the printer 1 (FIG. 8C). The correction values stored in the printer reflect the transport characteristics of each individual printer.

It should be noted that the printer, which has stored correction values, is packaged and delivered to a user. When the user is to print an image with the printer, the printer transports the paper based on the correction values and prints the image onto paper.

Measurement Pattern Printing (S101)

First, the printing of the measurement pattern is described. As with ordinary printing, the printer 1 prints the measurement pattern on paper by alternately repeating a dot forming process in which dots are formed by ejecting ink from moving nozzles, and a transport operation in which the paper is transported in the transport direction. It should be noted that in the description hereinafter, the dot forming process is referred to as a "pass" and an n-th dot forming process is referred to as "pass n".

Figure 9:
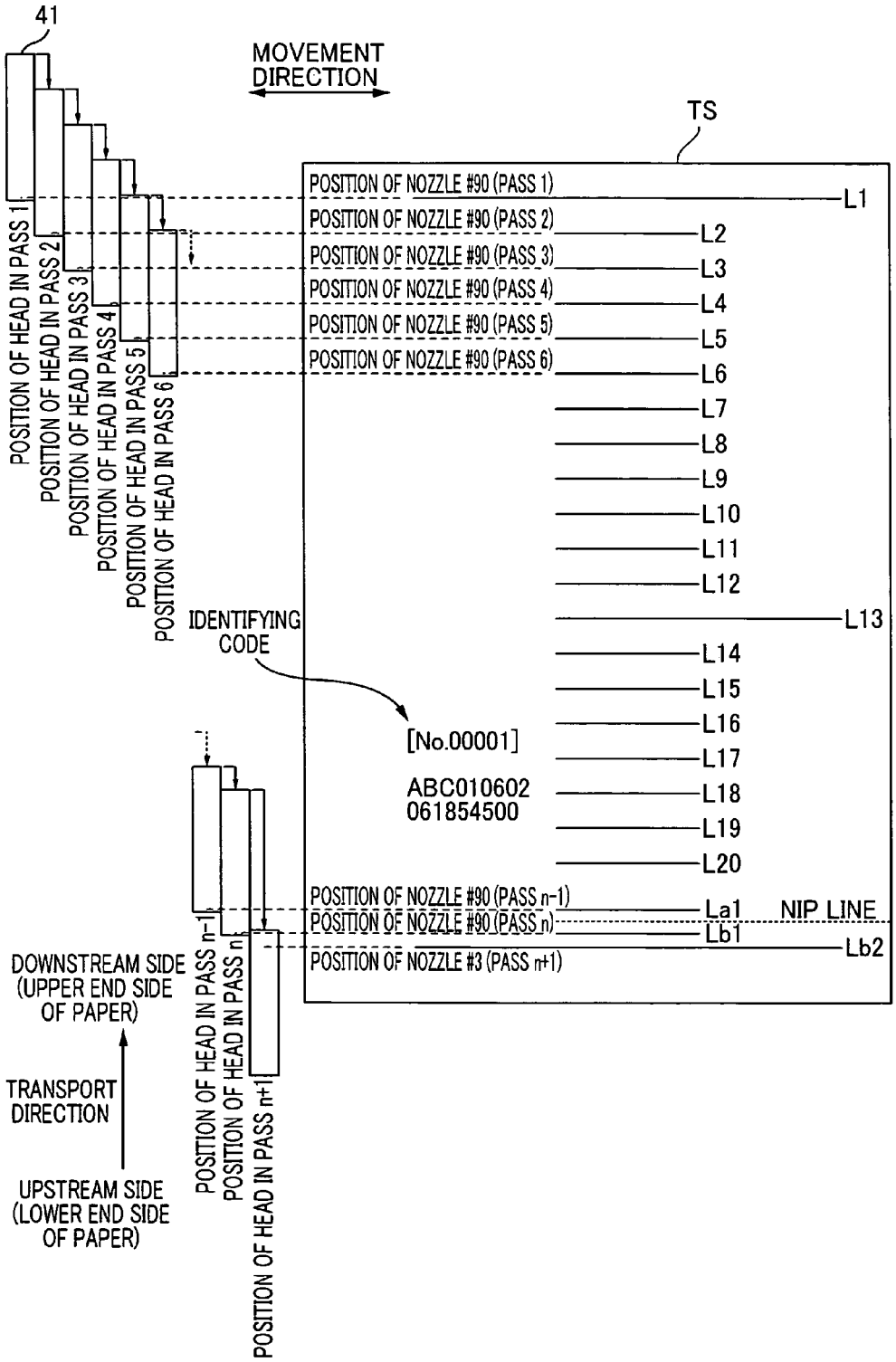
FIG. 9 is an explanatory diagram illustrating a state of printing a measurement pattern.

FIG. 9 is an explanatory diagram illustrating a state of printing a measurement pattern. The size of the test sheet TS on which the measurement pattern is to be printed is 101.6 mm×152.4 mm (4×6 inches).

The measurement pattern printed on the test sheet TS is shown on the right side of FIG. 9. The rectangles on the left side of FIG. 9 indicate the position (the relative position with respect to the test sheet TS) of the head 41 at each pass. To facilitate description, the head 41 is illustrated as if moving with respect to the test sheet TS, but FIG. 9 shows the relative positional relationship of the head and the test sheet TS and in fact the test sheet TS is being transported intermittently in the transport direction.

When the test sheet TS continues to be transported, the lower end of the test sheet TS passes over the transport roller 23. The position on the test sheet TS in opposition to the most upstream nozzle #90 when the lower end of the test sheet TS passes over the transport roller 23 is shown by a dotted line in FIG. 9 as a "NIP line". That is, in passes where the head 41 is higher than the NIP line in FIG. 9, printing is carried out in a state in which the test sheet TS is sandwiched between the transport roller 23 and the driven rollers 26 (also referred to as a "NIP state"). Furthermore, in passes where the head 41 is lower than the NIP line in FIG. 9, printing is carried out in a state in which the test sheet TS is not between the transport roller 23 and the driven rollers 26 (which is a state in which the test sheet TS is transported by only the discharge rollers 25 and the driven rollers 27 and is also referred to as a "non NIP state").

The measurement pattern is constituted by an identifying code and a plurality of lines.

The identifying code is a symbol for individual identification for identifying each of the individual printers 1 respectively. The identifying code is also read together when the measurement pattern is read at S102, and is identified in the computer 110 using OCR character recognition.

Each of the lines is formed in the movement direction. More lines are formed on the upper end side of the NIP line. The plurality of lines on the upper end side from the NIP line are numbered "Li" in order from the upper end side for each i-th line, and the line closest to the NIP line (the line positioned furthest on the lower end side among the plurality of lines on the upper end side from the NIP line) is referred to as La1. Furthermore, two lines are formed on the lower end side from the NIP line. Of the two lines on the lower end side from the NIP line, the upper side line is numbered Lb1 and the lower side line (the lowest line) is numbered Lb2. Specific lines are formed longer than other lines. For example, line L1, line L13, and line Lb2 are formed longer compared to the other lines. These lines are formed as follows.

First, after the test sheet TS is transported to a predetermined print commencement position, ink droplets are ejected only from nozzle #90 in pass 1, thereby forming the line L1. After pass 1, the controller 60 causes the transport roller 23 to perform a ¼ rotation so that the test sheet TS is transported by approximately ¼ inch. After transport, ink droplets are ejected only from nozzle #90 in pass 2, thereby forming the line L2. Thereafter, the same operation is repeated and the lines L1 to L20 are formed at intervals of approximately ¼ inch. In this manner, the line L1 to line L20, which are on the upper end side from the NIP line, are formed using the most upstream nozzle #90 of the nozzles #1 to nozzle #90. In this way, the most lines possible can be formed on the test sheet TS in the NIP state. It should be noted that although line L1 to line L20 are formed using only nozzle #90, nozzles other than the nozzle #90 are used when printing the identifying code in the pass in which the identifying code is printed.

Furthermore, immediately before the lower end of the test sheet TS has passes the transport roller 23, ink droplets are ejected from only nozzle #90 in pass n−1, thereby forming the line La1. After pass n−1, the controller 60 causes the transport roller 23 to perform a ⅙ rotation (as is described later, since a transition from the NIP state to the non NIP state is carried out during this rotation, of the transport roller 23 and the discharge rollers 25, only the discharge rollers 25 transport paper at this time) so that the test sheet TS is transported by approximately ⅙ inch. Then, after the lower end of the test sheet TS has passed the transport roller 23, ink droplets are ejected from only nozzle #90 in pass n, thereby forming the line Lb1. That is, in pass n−1, printing is carried out in the NIP state to form the line La1 and, in pass n, printing is carried out in the non NIP state to form the line Lb1. And to ensure this occurs, the dot forming process timings are set for pass n−1 and pass n.

Further still, after ink droplets are ejected from only the nozzle #90 in pass n and the line Lb1 is formed, the controller 60 causes the discharge rollers 25 to rotate so that the test sheet TS is transported by approximately one inch. After this transport, ink droplets are ejected from only the nozzle #3 in pass n+1, thereby forming the line Lb2. Supposing nozzle #1 was used, the interval between the line Lb1 and the line Lb2 would be extremely narrow (approximately 1/90 inch), which would make measuring difficult when the interval between the line Lb1 and the line Lb2 is measured later. For this reason, in the present embodiment, the interval between the line Lb1 and the line Lb2 is widened by forming the line Lb2 using nozzle #3, which is on the upstream side from the nozzle #1 in the transport direction, thereby facilitating measurement.

Incidentally, when transport of the test sheet TS is carried out ideally, the interval between the lines from line L1 to line L20 should be precisely ¼ inch. However, when there is transport error, the line interval is not ¼ inch. If the test sheet TS is transported more than an ideal transport amount, then the line interval widens. Conversely, if the test sheet TS is transported less than an ideal transport amount, then the line interval narrows. That is, the interval between certain two lines reflects the transport error in the transport process carried out between a pass in which one of the lines is formed and a pass in which the other of the lines is formed. For this reason, by measuring the interval between two lines, it is possible to measure the transport error in the transport process carried out between a pass in which one of the lines is formed and a pass in which the other of the lines is formed.

Similarly, the interval between the line La1 and the line Lb1 should be precisely ⅙ inch when transport of the test sheet TS is carried out ideally. However, when there is transport error, the line interval is not ⅙ inch. For this reason, it is conceivable that the interval between the line La1 and the line Lb1 reflects transport error in the transport process at a time of a transition from the NIP state to the non NIP state. Consequently, if the interval between the line La1 and the line Lb1 is measured, it is possible to measure the transport error in the transport process at the time of the transition from the NIP state to the non NIP state.

Furthermore, the interval between the line Lb1 and the line Lb2 should be precisely 3/90 inch when transport of the test sheet TS is carried out ideally (or more accurately, also when the ejection of ink from the nozzle #90 and nozzle #3 is identical). However, when there is transport error, the line interval is not 3/90 inch. For this reason, it is conceivable that the interval between the line Lb1 and the line Lb2 reflects transport error in the transport process in the non NIP state. For this reason, if the interval between the line Lb1 and the line Lb2 is measured, it is possible to measure the transport error in the transport process in the non NIP state.

Pattern Reading (S102)

Scanner Configuration

First, description is given regarding the configuration of the scanner 150 used in reading the measurement pattern.

Figure 10A:
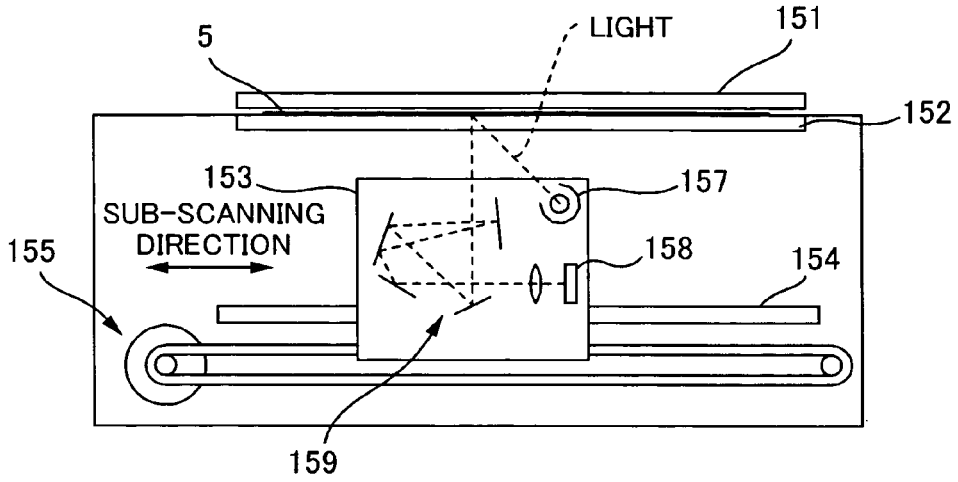
FIG. 10A is a vertical cross-sectional view of a scanner 150.
Figure 10B:
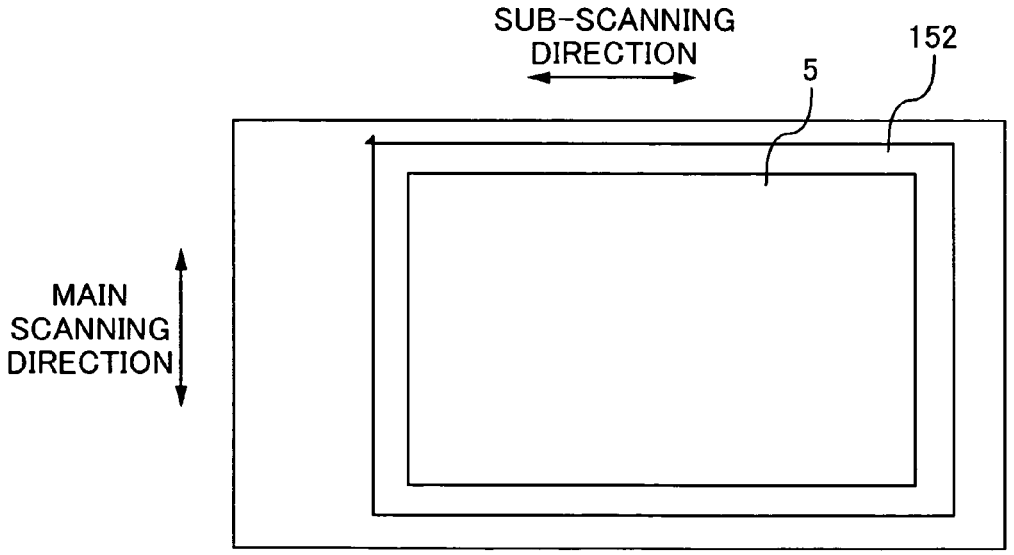
FIG. 10B is a top view of the scanner 150 with an upper cover 151 removed.

FIG. 10A is a vertical cross-sectional view of the scanner 150. FIG. 10B is a top view of the scanner 150 with an upper cover 151 removed.

The scanner 150 is provided with the upper cover 151, a document plate glass 152 on which a document 5 is placed, and a reading carriage 153 that moves in a sub-scanning direction while opposing the document 5 via the document plate glass 152, a guiding member 154 that guides the reading carriage 153 in the sub-scanning direction, a moving mechanism 155 for moving the reading carriage 153, and a scanner controller (not shown) that controls each section of the scanner 150. The reading carriage 153 is provided with an exposure lamp 157 for irradiating the document 5 with light, a line sensor 158 that detects an image of a line in the main-scanning direction (a direction perpendicular to the paper surface in FIG. 10A) and an optical system 159 for guiding light reflected by the document 5 to the line sensor 158. The dashed line inside the reading carriage 153 of FIG. 10A indicates the light trajectory.

When reading an image of the document 5, an operator opens the upper cover 151 and places the document 5 on the document plate glass 152, and closes the upper cover 151. Then, the scanner controller causes the reading carriage 153 to move in the sub-scanning direction while causing the exposure lamp 157 to emit light, and reads an image of the surface of the document 5 with the line sensor 158. The scanner controller transmits the image data that is read to a scanner driver of the computer 110, and the computer 110 obtains the image data of the document 5.

Reading Position Accuracy

As is described later, in the present embodiment, the scanner 150 scans the measurement pattern of the test sheet TS and the standard pattern of the standard sheet at a resolution of 720 dpi (main scanning direction)×720 dpi (sub-scanning direction). Thus, in the following description, a resolution of 720×720 dpi is assumed in scanning images.

Figure 11:
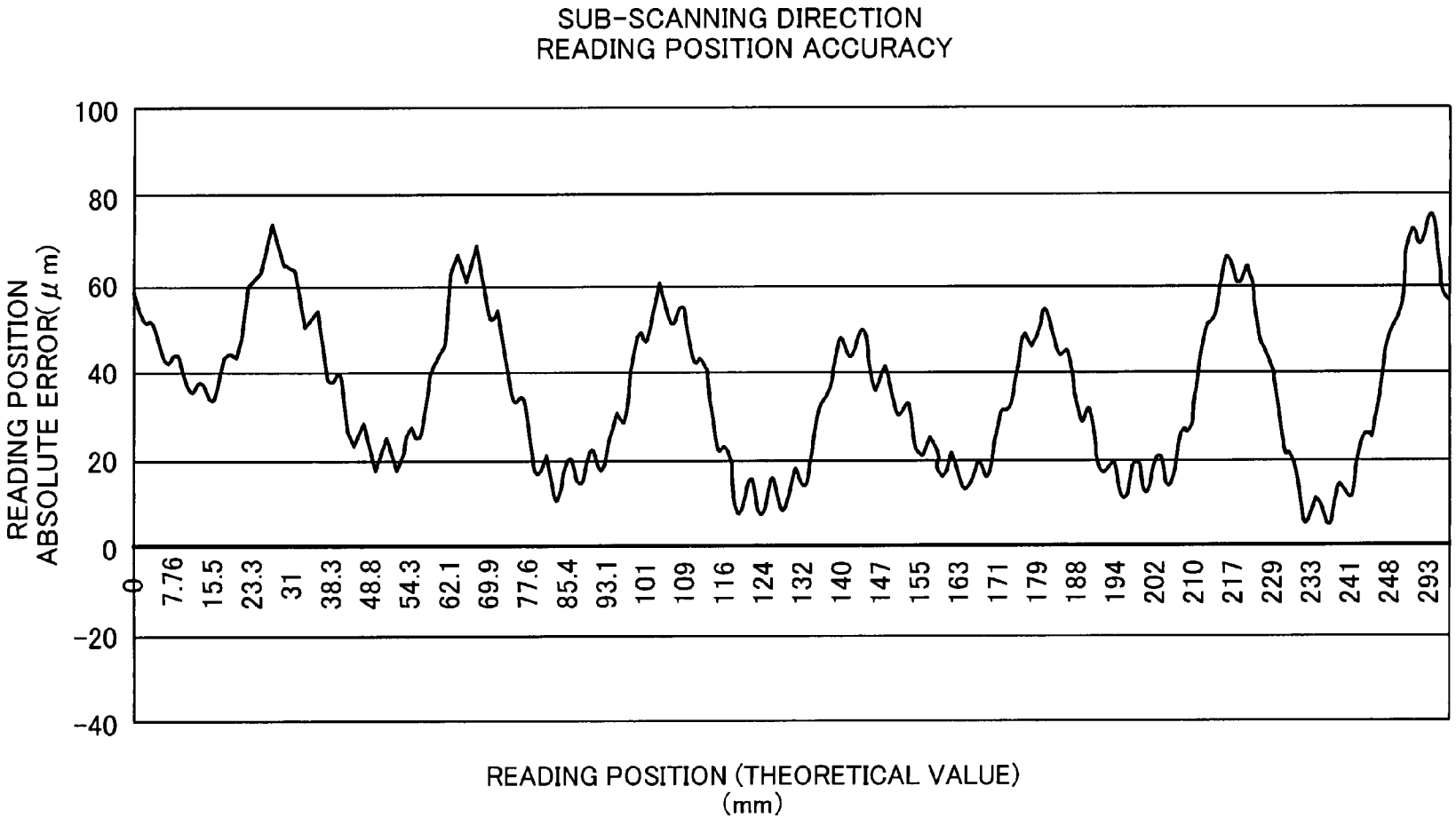
FIG. 11 is a graph of the reading position error of the scanner.

FIG. 11 is a graph of the reading position error of the scanner. The horizontal axis in the graph indicates reading positions (theoretical values) (that is, the horizontal axis in the graph indicates positions (theoretical values) of the reading carriage 153). The vertical axis in the graph indicates reading position error (difference between the theoretical values of reading positions and actual reading positions). For example, when the reading carriage 153 is caused to move 1 inch (=25.4 mm), an error of approximately 60 μm is produced.

Suppose that if the actual reading position matches the theoretical value of the reading position, a pixel that is 720 pixels apart in the sub-scanning direction from a pixel indicating a reference position (a position where the reading position is zero) should indicate an image in a position precisely one inch from the reference position. However, when a reading position error occurs as shown in the graph, the pixel that is 720 pixels apart in the sub-scanning direction from the pixel indicating a reference position indicates an image in a position that is a further 60 μm apart from the position that is one inch apart from the reference position.

Furthermore, suppose that there is zero tilt in the graph, the image should be read having a uniform interval each 1/720 inch. However, when the graph is tilted to the positive side, the image is read at an interval longer than 1/720 inch. And when the graph is tilted to the negative side, the image is read at an interval shorter than 1/720 inch.

As a result, even supposing the lines of the measurement pattern are formed having uniform intervals, the line images in the image data will not have uniform intervals in a state in which there is reading position error. In this manner, in a state in which there is reading position error, line positions cannot be accurately measured by simply reading the measurement pattern.

Consequently, in the present embodiment, when the test sheet TS is set and the measurement pattern is read by the scanner, a standard sheet is set and a standard pattern is also read.

Reading of Measurement Pattern and Standard Pattern

Figure 12A:
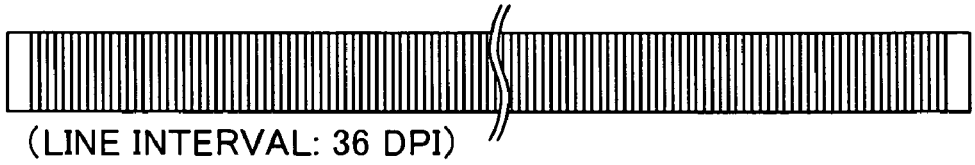
FIG. 12A is an explanatory diagram of a standard sheet SS and FIG. 12B is an explanatory diagram of a condition in which a test sheet TS and the standard sheet SS are set on an document plate glass 152.
Figure 12B:
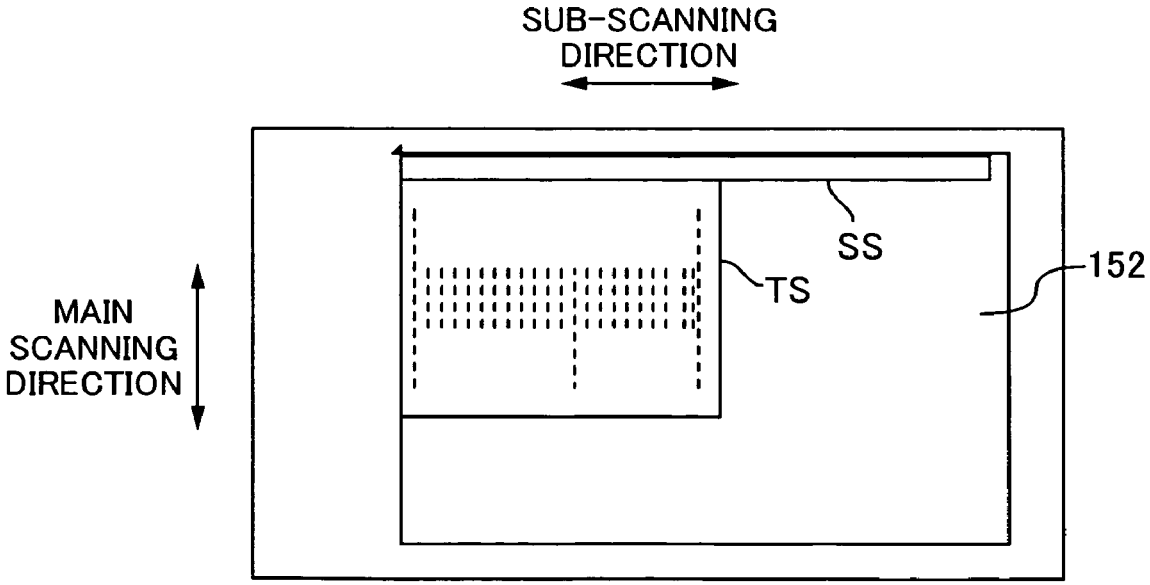

FIG. 12A is an explanatory diagram of a standard sheet SS. FIG. 12B is an explanatory diagram of a condition in which the test sheet TS and the standard sheet SS are set on the document plate glass 152.

A size of the standard sheet SS is 10 mm×300 mm, and the standard sheet SS has a long narrow shape. A multitude of lines are formed as a standard pattern at intervals of 36 dpi on the standard sheet SS. Since the standard sheet SS is used repetitively, it is made not of paper but rather of a PET film. Furthermore, the standard pattern is formed with high precision using laser processing.

The test sheet TS and the standard sheet SS are set in a predetermined position on the document plate glass 152 using a jig not shown in the drawings. The standard sheet SS is set on the document plate glass 152 in such a manner as its long sides are parallel to the sub-scanning direction of the scanner 150, that is, in such a manner as each line of the standard sheet SS is parallel to the main scanning direction of the scanner 150. The test sheet TS is set beside the standard sheet SS. The test sheet TS is set on the document plate glass 152 in such a manner as its long sides are parallel to the sub-scanning direction of the scanner 150, that is, in such a manner as each line of the measurement pattern is parallel in the main scanning direction.

With the test sheet TS and the standard sheet SS set in this manner, the scanner 150 reads the measurement pattern and the standard pattern. At this time, due to the influence of reading position error, the image of the measurement pattern in the reading result is a distorted image compared to the actual measurement pattern. Similarly, the image of the standard pattern is also a distorted image compared to the actual standard pattern.

It should be noted that the image of the measurement pattern in the reading result is affected not only by the reading position error, but also by the transport error of the printer 1. On the other hand, the standard pattern is formed having uniform intervals without any relation to the transport error of the printer, and therefore the image of the standard pattern is affected by the reading position error in the scanner 150, but is not affected by the transport error of the printer 1.

Consequently, the program for obtaining correction values cancels the influence of reading position error in the image of the measurement pattern based on the image of the standard pattern when calculating correction values based on the image of the measurement pattern.

Calculation of Correction Values (S103)

Before describing the calculation of correction values, description is given regarding the image data obtained from the scanner 150. The image data is constituted by a plurality of units of pixel data. The data for each pixel indicates a tone value of the corresponding pixel. Ignoring scanner reading error, each pixel corresponds to a size of $1/720 \times 1/720$ inches. An image (digital image) is constituted by pixels such as these as a smallest structural unit, and image data is data that represents an image such as this.

Figure 13:
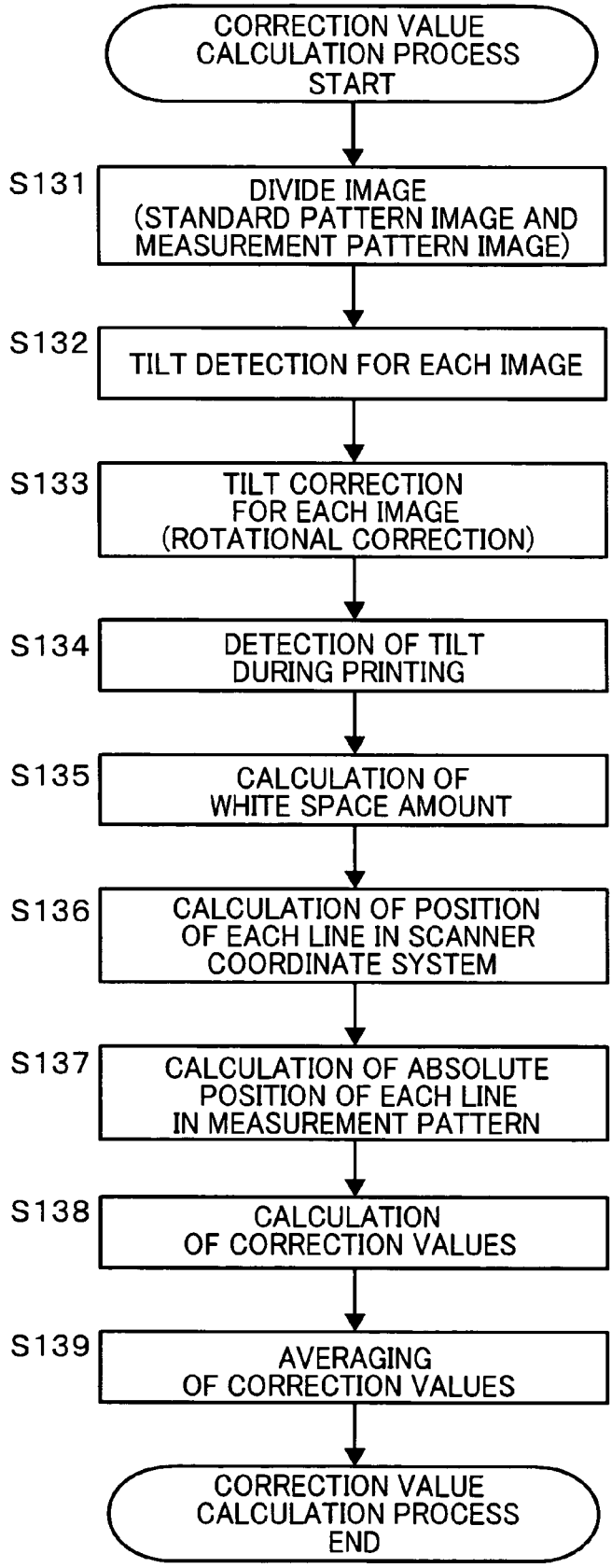
FIG. 13 is a flowchart of a correction value calculating process in S103.

FIG. 13 is a flowchart of a correction value calculating process in S103. The computer 110 executes each process in accordance with the program for obtaining correction values. That is, the program for obtaining correction values contains code for causing each process to be executed in the computer 110.

Image Division (S131)

First, the computer 110 divides into two the image represented by the image data obtained from the scanner 150 (S131)

Figure 14:
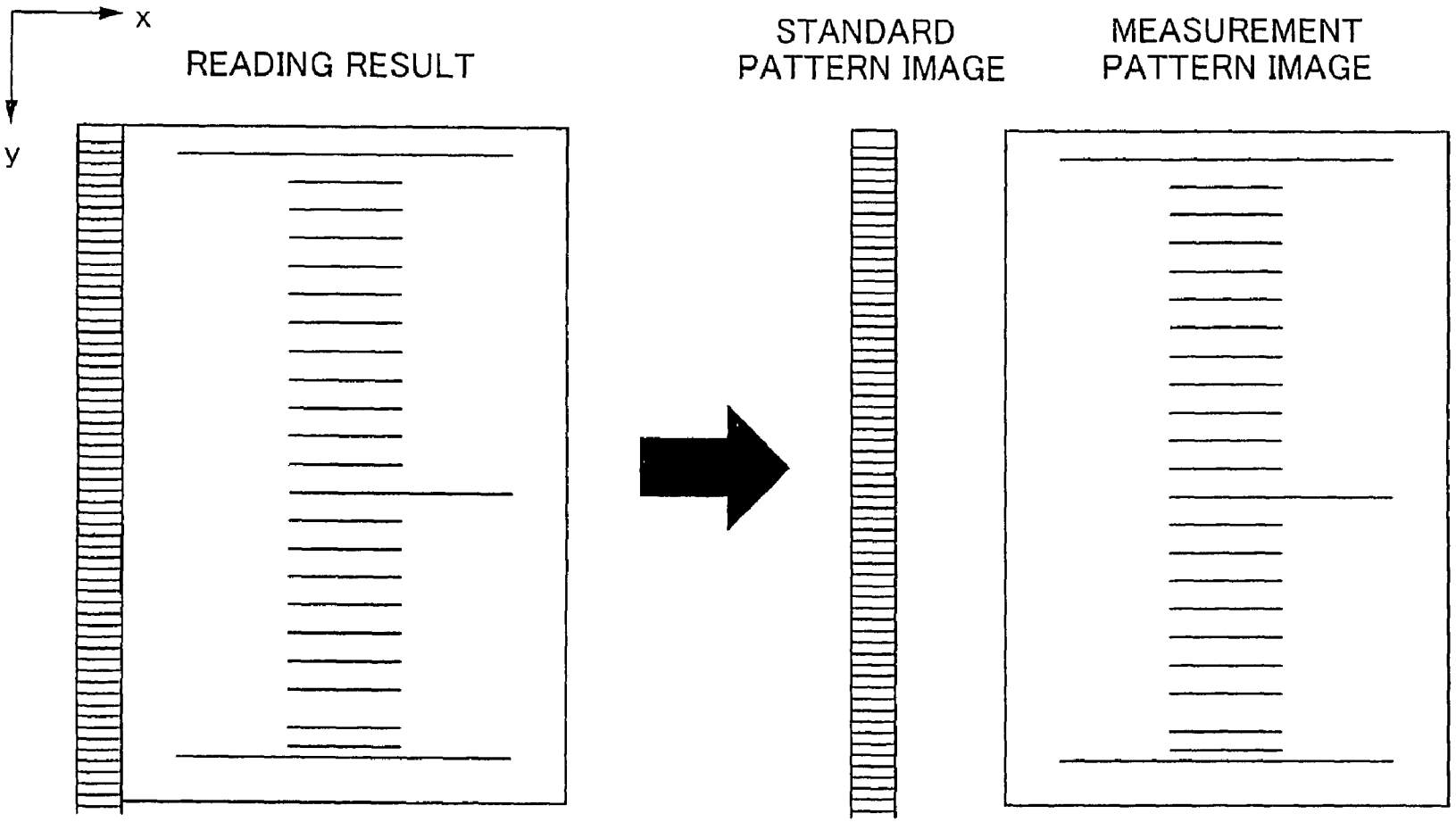
FIG. 14 is an explanatory diagram of image division (S131)

FIG. 14 is an explanatory diagram of image division (S131). On the left side of FIG. 14, an image represented by image data obtained from the scanner is depicted. On the right side of FIG. 14, a divided image is shown. In the following description, the left-right direction (horizontal direction) in FIG. 14 is referred to as an x direction and the up-down direction (vertical direction) in FIG. 14 is referred to as a y direction. The lines in the image of the standard pattern are substantially parallel to the x direction and the lines in the image of the measurement pattern are also substantially parallel to the x direction.

The computer 110 divides the image into two by extracting an image of a predetermined range from the image of the reading result. By dividing the image of the reading result into two, one of the images indicates an image of the standard pattern and the other of the images indicates an image of the measurement pattern. A reason for dividing in this manner is that since there is a risk that the standard sheet SS and the test sheet TS are set in the scanner 150 with different tilts, tilt correction (S133) is performed on these separately.

Image Tilt Detection (S132)

Next, the computer 110 detects the tilt of the images (S132).

Figure 15A:
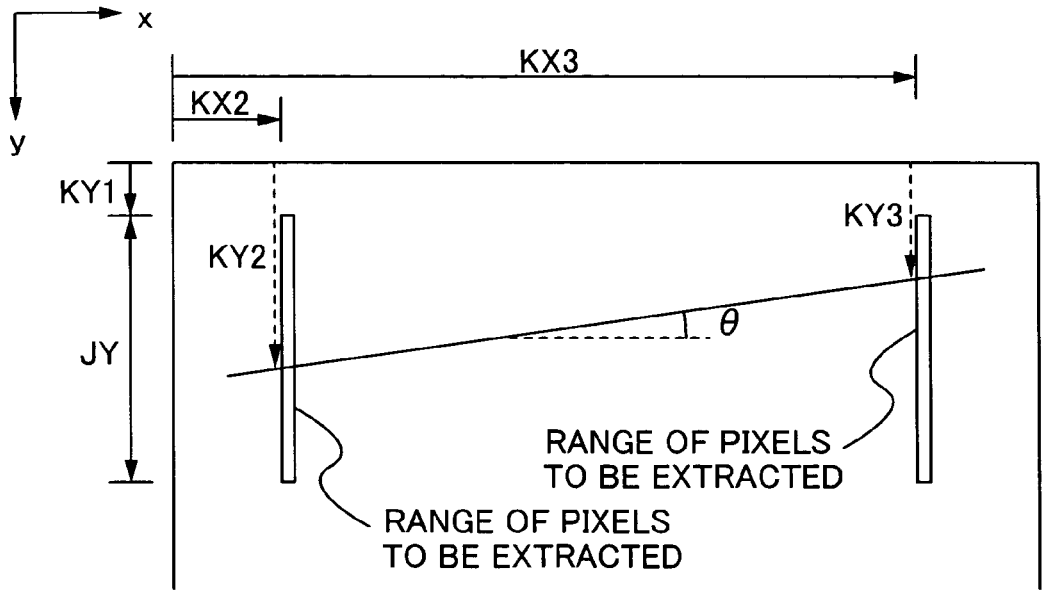
FIG. 15A is an explanatory diagram showing how tilt of an image of the measurement pattern is detected.

FIG. 15A is an explanatory diagram showing how tilt of an image of the measurement pattern is detected. From the image data, the computer 110 extracts JY number of pixels which are located KX2-th from the left and KY1-th and lower from the top. Similarly, from the image data, the computer 110 extracts JY number of pixels which are located KX3-th from the left and KY1-th and lower from the top. It should be noted that the parameters KX2, KX3, KY1, and JY are set in such a manner as pixels indicating the line L1 are contained in the extracted pixels.

Figure 15B:
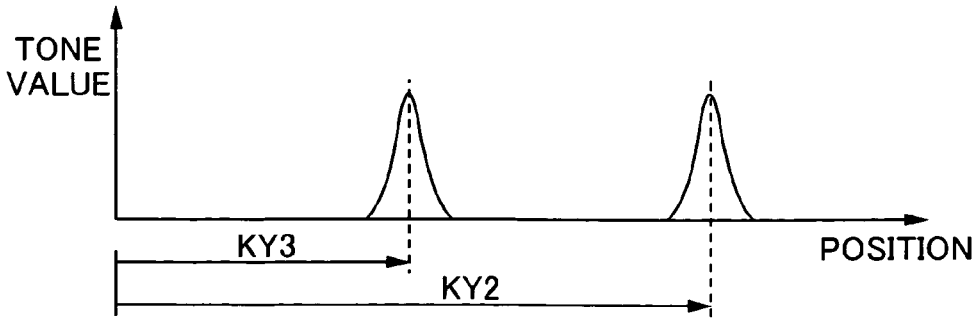
FIG. 15B is a graph of tone values of extracted pixels.

FIG. 15B is a graph of tone values of extracted pixels. The horizontal axis indicates pixel positions (Y coordinates). The vertical axis indicates the tone values of the pixels. The computer 110 obtains centroid positions KY2 and KY3 respectively based on pixel data of the JY number of pixels that have been extracted.

Then, the computer 110 calculates a tilt θ of the line L1 using the following expression:

$$\theta = \tan^{-1}\{(KY2 - KY3)/(KX2 - KX3)\}$$

It should be noted that the computer 110 detects not only the tilt of the image of the measurement pattern but also the tilt of the image of the standard pattern. The method for detecting the tilt of the image of the standard pattern is substantially the same as the method described above, and therefore its description is omitted.

Image Tilt Correction (S133)

Next, the computer 110 corrects the image tilt by performing a rotation process on the image based on the tilt θ detected at S132 (S133). The image of the measurement pattern is rotationally corrected based on a tilt result of the image of the measurement pattern, and the image of the standard pattern is rotationally corrected based on a tilt result of the image of the standard pattern.

A bilinear technique is used in an algorithm for the rotation process of the image. This algorithm is well known, and therefore its description is omitted.

Tilt Detection During Printing (S134)

Next, the computer 110 detects the tilt (skew) during printing of the measurement pattern (S134). When the lower end of the test sheet passes the transport roller while printing the measurement pattern, sometimes the lower end of the test sheet contacts the head 41 so that the test sheet moves. When this occurs, the correction values calculated using this measurement pattern become inappropriate. Therefore, whether or not the lower end of the test sheet has made contact with the head 41 is detected by detecting the tilt at the time of printing the measurement pattern, and if contact has been made, this is taken as an error.

Figure 16:
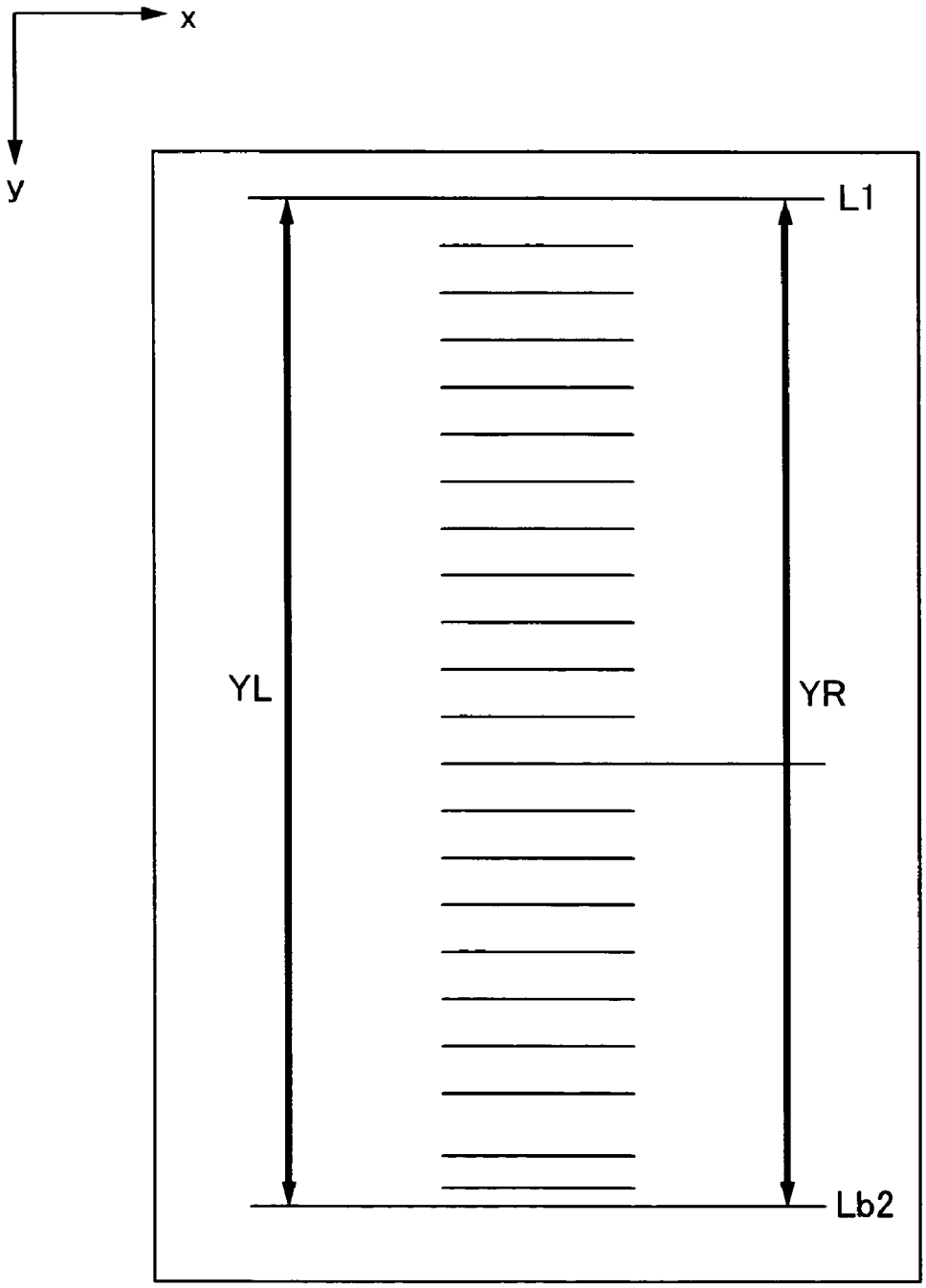
FIG. 16 is an explanatory diagram showing how tilt during printing of the measurement pattern is detected.

FIG. 16 is an explanatory diagram showing how tilt during printing of the measurement pattern is detected. First, the computer 110 detects a left side interval YL and a right side interval YR between the line L1 (the uppermost line) and the line Lb2 (the bottommost line, which is a line formed after the lower end has passed over the transport roller). Then the computer 110 calculates the difference between the interval YL and the interval YR and proceeds to the next process (S135) if this difference is within a predetermined range, but takes it as an error if this difference is outside the predetermined range.

Calculating Amount of White Space (S135)

Next, the computer 110 calculates the amount of white space (S135).

Figure 17:
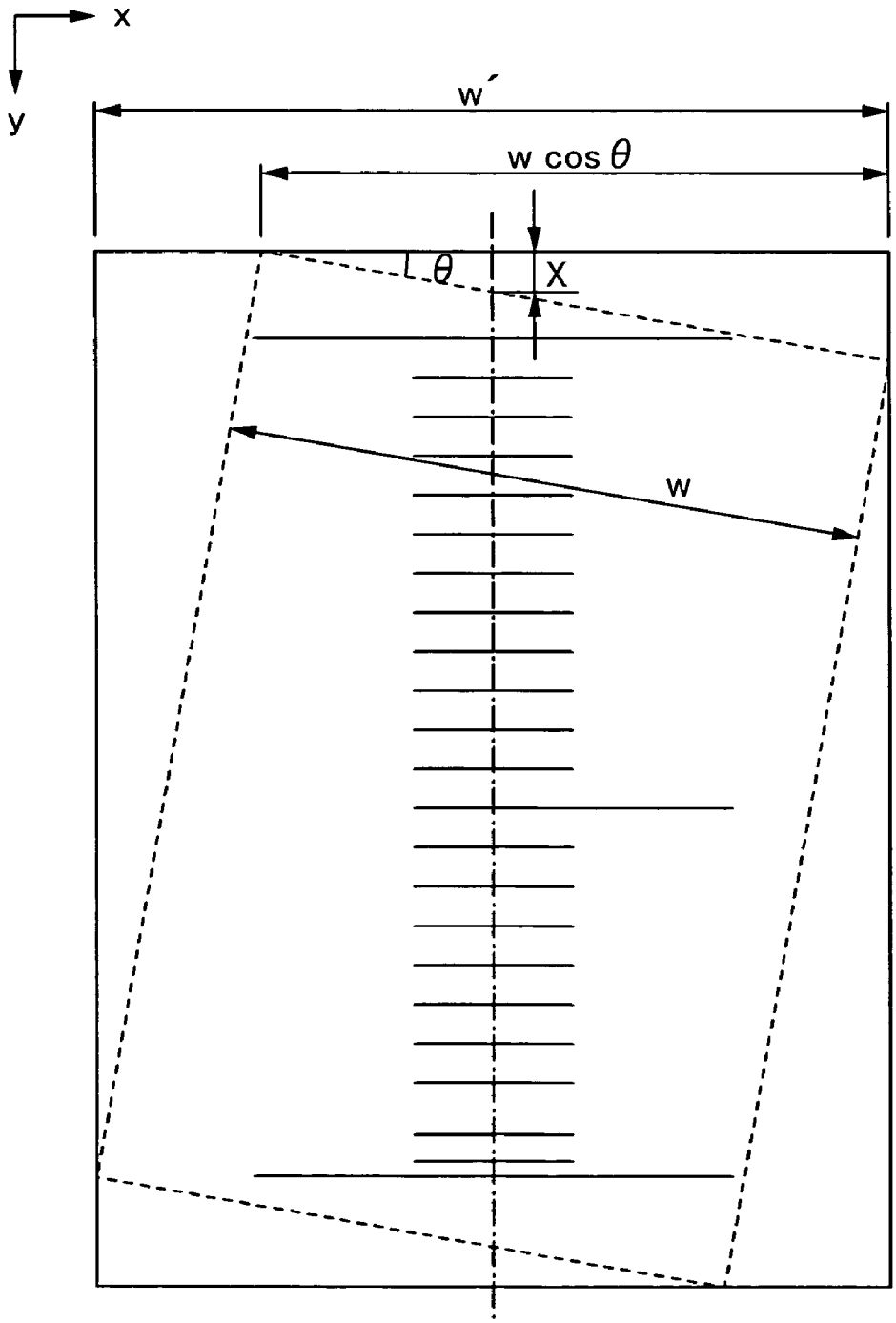
FIG. 17 is an explanatory diagram of a white space amount X.

FIG. 17 is an explanatory diagram of a white space amount X. The solid line quadrilateral (outer quadrilateral) in FIG. 17 indicates an image after the rotational correction of S133. The dotted line quadrilateral (inner diagonal quadrilateral) in FIG. 17 indicates an image prior to the rotational correction. In order to make the image after rotational correction a rectangular shape, white spaces of right-angled triangle shapes are added to the four corners of the rotated image when carrying out the rotational correction process at S133.

Supposing the tilt of the standard sheet SS and the tilt of the test sheet TS are different, the added white space amount will be different. Consequently, the positions of the lines in the measurement pattern with respect to the standard pattern will be relatively shifted before and after the rotational correction (S133) Accordingly, the computer 110 obtains the white space amount X using the following expression and prevents displacement of the lines of the measurement pattern with respect to the standard pattern by subtracting the white space amount X from the line positions calculated in S136.

$$X=(w\cos\theta-W'/2)\times\tan\theta$$

Line Position Calculations in Scanner Coordinate System (S136)

Next, the computer 110 calculates the line positions of the standard pattern and the line positions of the measurement pattern respectively using a scanner coordinate system (S136).

The scanner coordinate system refers to a coordinate system when the size of one pixel is $1/720\times1/720$ inches. There is reading position error in the scanner 150 and strictly speaking the actual region corresponding to each piece of pixel data does not become $1/720\times1/720$ inches when consideration is given to the reading position error; but, in the scanner coordinate system, the size of a region (pixel) corresponding to each piece of pixel data is assumed to be $1/720\times1/720$ inches. Furthermore, a position of the upper left pixel in each image is set as an origin in the scanner coordinate system.

Figure 18A:
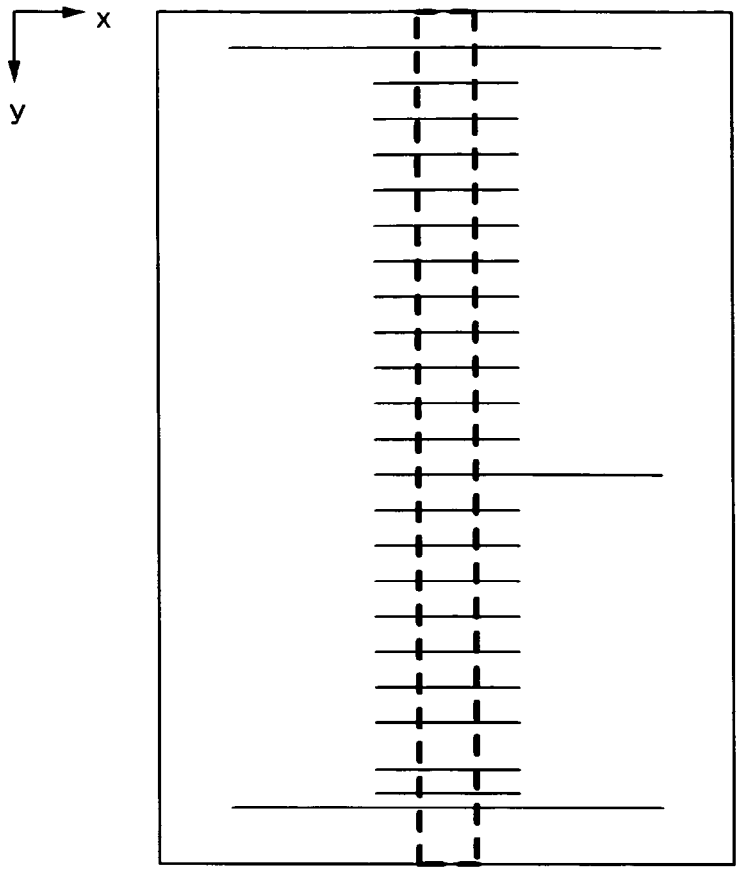
FIG. 18A is an explanatory diagram of an image range used in calculating line positions.
Figure 18B:
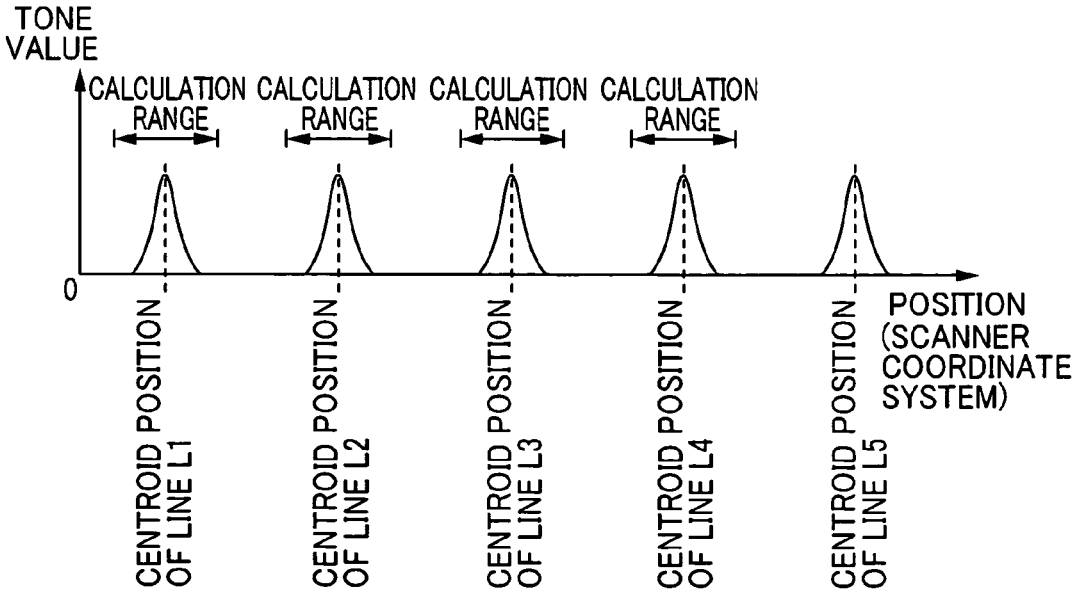
FIG. 18B is an explanatory diagram of calculating line positions.

FIG. 18A is an explanatory diagram of an image range used in calculating line positions. The image data of the image in the range indicated by the dashed line in FIG. 18A is used in calculating the line positions. FIG. 18B is an explanatory diagram of calculating line positions. The horizontal axis indicates the positions in the y direction of the pixels (scanner coordinate system). The vertical axis indicates tone values of the pixels (average values of tone values of the pixels lined up in the x direction).

The computer 110 obtains a position of a peak value of the tone values and sets a certain range centered on this position as a calculation range. Then, based on the pixel data of pixels in this calculation range, the centroid position of the tone values is calculated, and the calculated centroid position is set as the line position.

Figure 19:
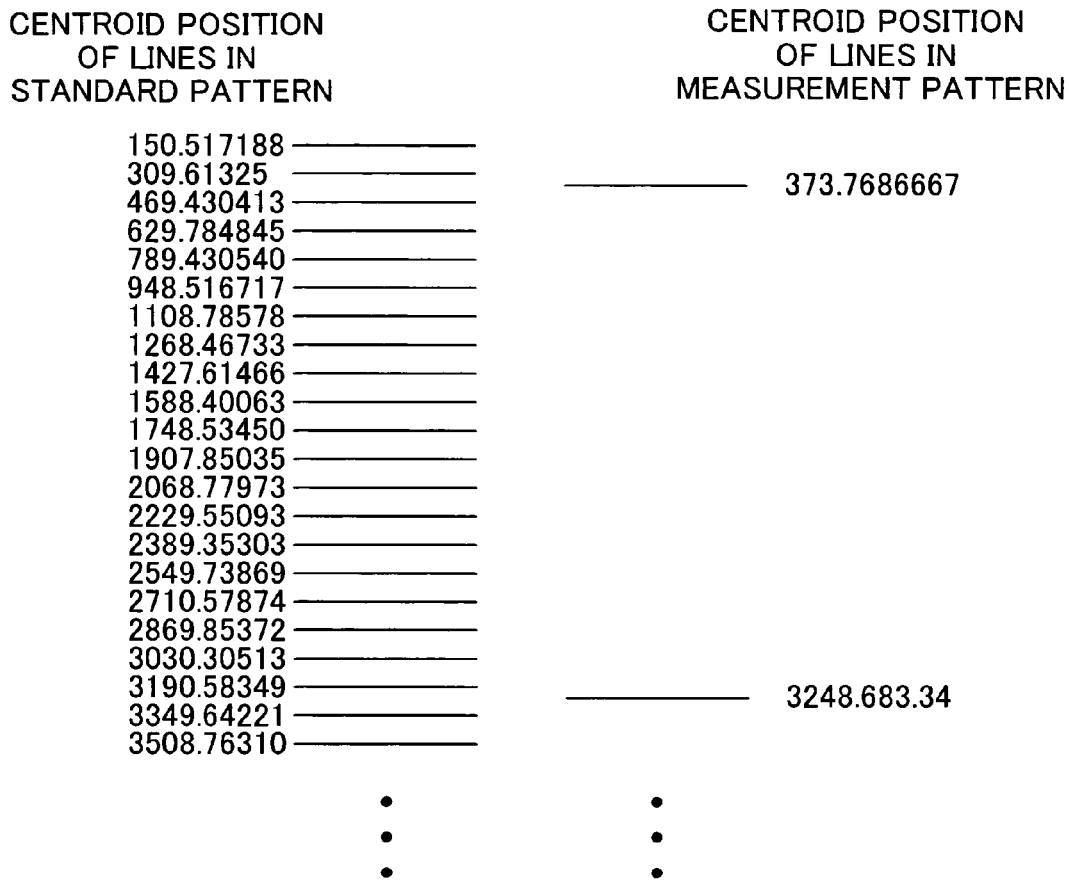
FIG. 19 is an explanatory diagram of calculated line positions.

FIG. 19 is an explanatory diagram of calculated line positions (note that positions shown in FIG. 19 have undergone a predetermined calculation to be made dimensionless). In regard to the standard pattern, despite being constituted by lines having uniform intervals, its calculated line positions do not have uniform intervals when attention is given to the centroid positions of each line in the standard pattern. This is conceivably an influence of reading position error of the scanner 150.

Calculating Absolute Positions of Lines in Measurement Pattern (S137)

Next, the computer 110 calculates the absolute positions of the lines in the measurement pattern (S137).

Figure 20:
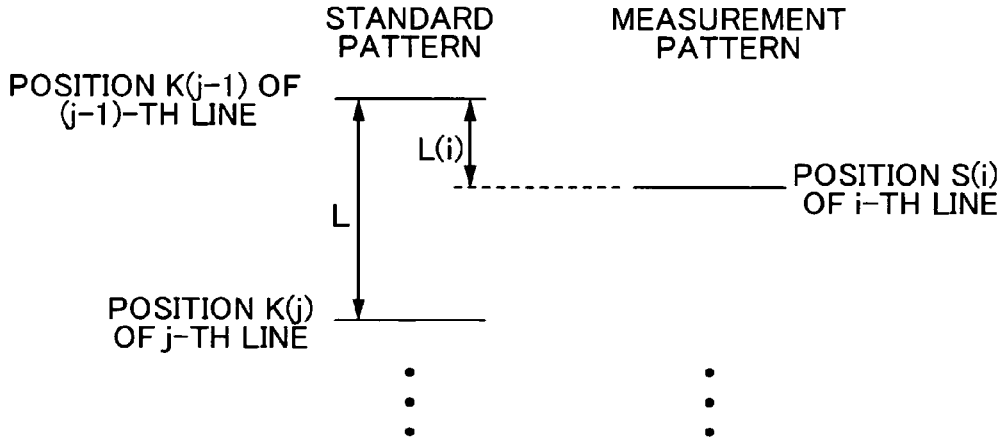
FIG. 20 is an explanatory diagram of calculating absolute positions of an i-th line in the measurement pattern.

FIG. 20 is an explanatory diagram of calculating absolute positions of an i-th line in the measurement pattern. Here, the i-th line of the measurement pattern is positioned between the (j−1)-th line of the standard pattern and the j-th line of the standard pattern. In the following description, the position (scanner coordinate system) of the i-th line in the measurement pattern is referred to as "S(i)" and the position (scanner coordinate system) of the j-th line in the standard pattern is referred to as "K(j)". Furthermore, the interval (y direction interval) between the (j−1)-th line and the j-th line of the standard pattern is referred to as "L" and the interval (y direction interval) between the (j−1)-th line of the standard pattern and the i-th line of the measurement pattern is referred to as "L(i)".

First, the computer 110 calculates a ratio H of the interval L(i) to the interval L based on the following expression:

$$\begin{aligned} H &= L(i)/L \\ &= \{S(i)-K(j-1)/\{K(j)-K(j-1)\} \end{aligned}$$

Incidentally, the standard pattern on the actual standard sheet SS has uniform intervals, and therefore when the absolute position of the first line of the standard pattern is set to zero, the position of an arbitrary line in the standard pattern can be calculated. For example, the absolute position of the second line in the standard pattern is 1/36 inch. Accordingly, when the absolute position of the j-th line in the standard pattern is given as "J(j)" and the absolute position of the i-th line in the measurement pattern is given as "R(i)", then R(i) can be calculated as shown in the following expression:

$$R(i)=\{J(j)-J(j-1)\}\times H+J(j-1)$$

The following is a description of a specific procedure for calculating the absolute position of the first line of the measurement pattern in FIG. 19. First, based on the value (373.768667) of S(1), the computer 110 detects that the first line of the measurement pattern is positioned between the second line and the third line of the standard pattern. Next, the computer 110 calculates that the ratio H is 0.40143008 (=(373.7686667−309.613250)/(469.430413−309.613250). Next, the computer 110 calculates that an absolute position R(1) of the first line of the measurement pattern is 0.98878678 mm (=0.038928613 inches={1/36 inch}×0.40143008+1/36 inch).

In this manner, the computer 110 calculates the absolute positions of the lines in the measurement pattern.

Calculating Correction Values (S138)

Next, the computer 110 calculates correction values corresponding to multiple transport operations carried out when the measurement pattern is formed (S138). Each of the correction values is calculated based on a difference between a theoretical line interval and an actual line interval.

The correction value C(i) of the transport operation carried out between the pass i and the pass i+1 is a value in which "R(i+1)−R(i)" (the actual interval between the absolute position of the line L(i+1) and the line Li) is subtracted from "6.35 mm" (¼ inch, that is, the theoretical interval between the line Li and the line L(i+1)). For example, the correction value C(1) of the transport operation carried out between the pass 1 and the pass 2 is 6.35 mm−{R(2)−R(1)}. The computer 110 calculates the correction value C(1) to the correction value C(19) in this manner.

Furthermore, the correction value Cb1 of the transport operation carried out between the pass n−1 and the pass n is a value in which the actual interval between the absolute position of the line Lb1 and the line La1 is subtracted from "4.23 mm" (⅙ inch, that is, the theoretical interval between the line La1 and the line Lb1). The computer 110 calculates the correction value Cb1 in this manner.

Furthermore, the correction value Cb2 of the transport operation carried out between the pass n and the pass n+1 is a value in which the actual interval between the absolute position of the line Lb2 and the line Lb1 is subtracted from "0.847 mm" (3/50 inch, that is, the theoretical interval between the line Lb1 and the line Lb2). The computer 110 calculates the correction value Cb2 in this manner.

Figure 21:
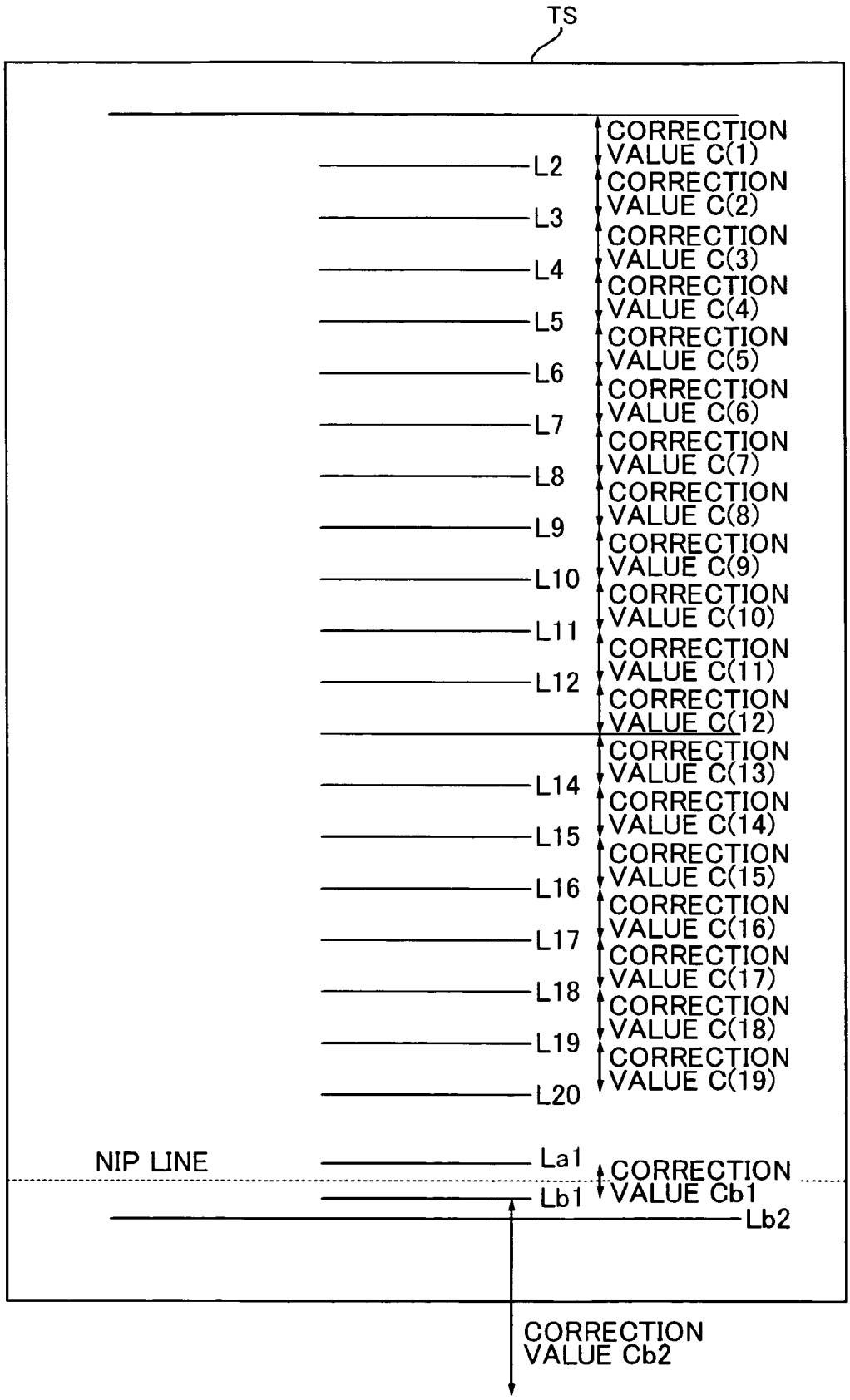
FIG. 21 is an explanatory diagram of a range associated with correction values C(i) and the like, FIG. 22 is an explanatory diagram of a relationship between the lines of the measurement pattern and the correction values Ca.

FIG. 21 is an explanatory diagram of a range associated with the correction values C(i) and the like. Supposing that a value obtained by subtracting the correction value C(1) from the initial target transport amount is set as a target in the transport operation between the pass 1 and the pass 2 when printing the measurement pattern, then the actual transport amount should become precisely ¼ inch (=6.35 mm). Similarly, supposing that a value obtained by subtracting the correction value Cb1 from the initial target transport amount is set as the target in the transport operation between the pass n−1 and the pass n when printing the measurement pattern, then the actual transport amount should become precisely ⅙ inch. Furthermore, supposing that a value obtained by subtracting the correction value Cb2 from the initial target transport amount is set as the target in the transport operation between the pass n and the pass n+1 when printing the measurement pattern, then the actual transport amount should become precisely 1 inch.

Averaging Correction Values (S139)

The rotary encoder 52 of the present embodiment is not provided with an origin sensor, and therefore although the controller 60 can detect the rotation amount of the transport roller 23, it does not detect the rotation position of the transport roller 23. For this reason, the printer 1 cannot guarantee the rotation position of the transport roller 23 at the commencement of transport. That is, each time printing is carried out, there is a risk that the rotation position of the transport roller 23 is different at the commencement of transport. On the other hand, the interval between two adjacent lines in the measurement pattern is affected not only by the DC component transport error when transported by ¼ inch, but is also affected by the AC component transport error.

Consequently, if a correction value that is calculated based on the interval between two adjacent lines in the measurement pattern is applied as it is when correcting the target transport amount, there is a risk that the transport amount will not be corrected properly due to the influence of the AC component transport error. For example, even when carrying out a transport operation of a ¼ inch transport amount between the pass 1 and the pass 2 in the same manner as when printing the measurement pattern, if the rotation position of the transport roller 23 at the commencement of transport is different from that at the time of printing the measurement pattern, then the transport amount will not be corrected properly even though the target transport amount is corrected with the correction value C(1). If the rotation position of the transport roller 23 at the commencement of transport is 180 degrees different compared to the time of printing the measurement pattern, then due to the influence of the AC component transport error, not only will the transport amount not be corrected properly, it is possible that the transport error will actually be worsened.

Accordingly, in the present embodiment, in order to correct only the DC component transport error, a correction amount Ca for correcting the DC component transport error is calculated by averaging four correction values C as in the following expression:

$$Ca(i)=\{C(i-1)+C(i)+C(i+1)+C(i+2)\}/4$$

Here, description is given regarding a reason for being able to calculate the correction values Ca for correcting DC component transport error by the above expression.

As described above, the correction value C(i) of the transport operation carried out between the pass i and the pass i+1 is a value obtained by subtracting "R(i+1)−R(i)" (the actual interval between the absolute position of the line L(i+1) and the line Li) from "6.35 mm" (¼ inch, that is, the theoretical interval between the line Li and the line L(i+1)). Thus, the above expression for calculating the correction values Ca possesses a meaning as in the following expression:

$$Ca(i)=[25.4\text{ mm}-\{R(i+3)-R(i-1)\}]/4$$

That is, the correction value Ca(i) is a value obtained by dividing by four a difference between an interval of two lines that should be separated by one inch in theory (the line L(i+3) and the line L(i−1)) and one inch (the transport amount of a full rotation of the transport roller 23). For this reason, the correction values Ca(i) are values for correcting ¼ of the transport error produced when the paper S is transported by one inch (the transport amount of one rotation of the transport roller 23). Then, the transport error produced when the paper S is transported by one inch is DC component transport error, and no AC component transport error is contained within this transport error.

Therefore, the correction values Ca(i) calculated by averaging four correction values C are not affected by the AC component transport error and are values that reflect the DC component transport error.

Figure 22:
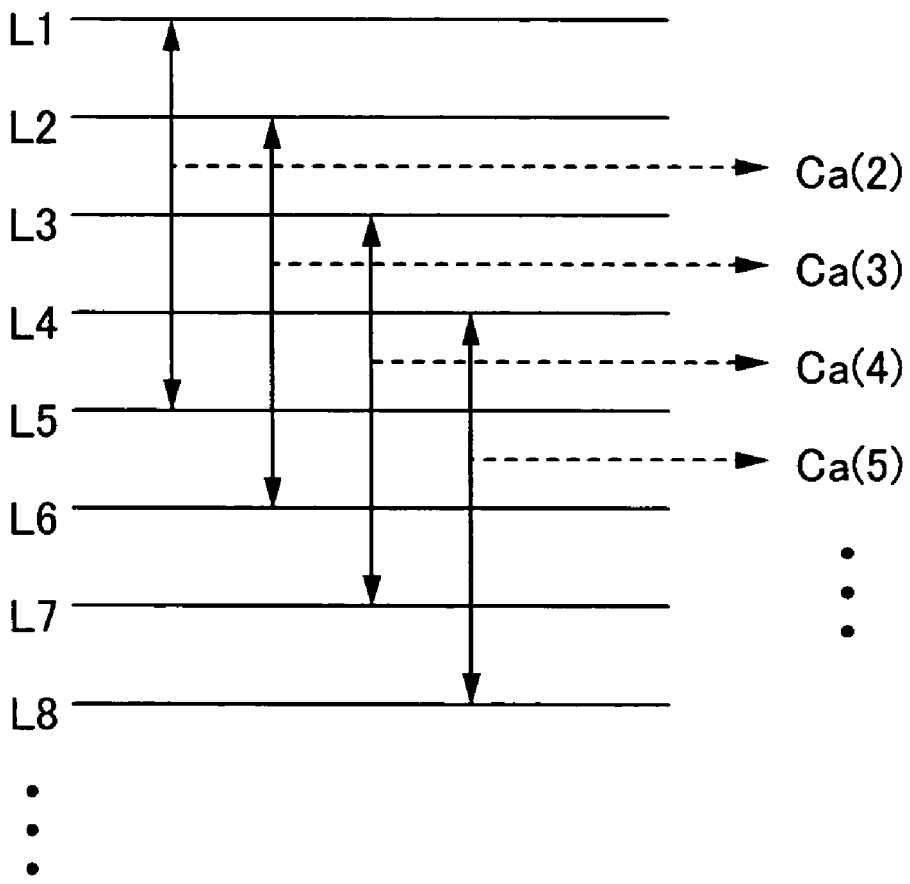

FIG. 22 is an explanatory diagram of a relationship between the lines of the measurement pattern and the correction values Ca. As shown in FIG. 22, the correction values Ca(i) are values corresponding to an interval between the line L(i+3) and the line L(i−1). For example, the correction value Ca(2) is a value corresponding to the interval between the line L5 and the line L1. Furthermore, since the lines in the measurement pattern are formed at substantially each ¼ inch, the correction value Ca can be calculated for each ¼ inch. For this reason, the correction values Ca(i) can be set in such a manner as each correction value Ca has an application range of ¼ inch, regardless of the value corresponding to the interval between two lines that theoretically should be separated by 1 inch. That is, in the present embodiment, the correction values for correcting DC component transport error can be set for each ¼ inch range rather than for each one inch range corresponding to one rotation of the transport roller 23. In this way, fine corrections can be performed on DC component transport error (see the dashed line in FIG. 6), which fluctuates in response to the total transport amount.

It should be noted that the correction value Ca(2) of the transport operation carried out between the pass 2 and the pass 3 is calculated to be a value obtained by dividing a sum total of the correction values C(1) to C(4) by four (an average value of the correction values C(1) to C(4)). In other words, the correction value Ca(2) is a value corresponding to the interval between the line L1 formed in the pass 1 and the line L5 formed in the pass 5 after one inch of transport has been performed after the forming of the line L1.

It should be noted in regard to the correction value Ca(l) that since there is no C(i−1) value in the expression for calculating the correction values Ca, the same value as Ca(2) can be used. Also, similarly in regard to the correction values Ca(18) and Ca(19), since there is no C(i+1) or C(i+2) in the expression for calculating the correction values Ca, the same value as Ca(17) can be used.

The computer 110 calculates the correction values Ca(1) to Ca(19) in this manner. Through this, the correction values for correcting DC component transport error are obtained for each ¼ inch range.

Incidentally, description was given above regarding the correction values Ca(i) of the transport operation between the pass i and the pass i+1 (i=1 to 19) (which were derived by averaging), the correction value Cb1 of the transport operation between the pass n−1 and the pass n, and the correction value Cb2 of the transport operation between the pass n and the pass n+1; but, no reference was made to the correction values of the transport operation between the pass 20 (the pass i+1 when i=19) and the pass n−1. Here, description is given regarding these correction values.

The same value as Ca(19) is used for the correction values of the transport operation between the pass 20 and the pass n−1 (these correction values are referred to as correction values Cc). However, since the theoretical interval between the line 19 and the line 20 (which is ¼ inch as described earlier) and the theoretical interval between the line 20 and the line La1 (which is p inches) are different, correction values Cc are calculated in consideration of this using the following expression:

$$Cc=Ca(19)\times(p/(1/4))$$

Storing Correction Values (S104)

Next, the computer 110 stores the correction values in the memory 63 of the printer 1 (S104).

Figure 23:
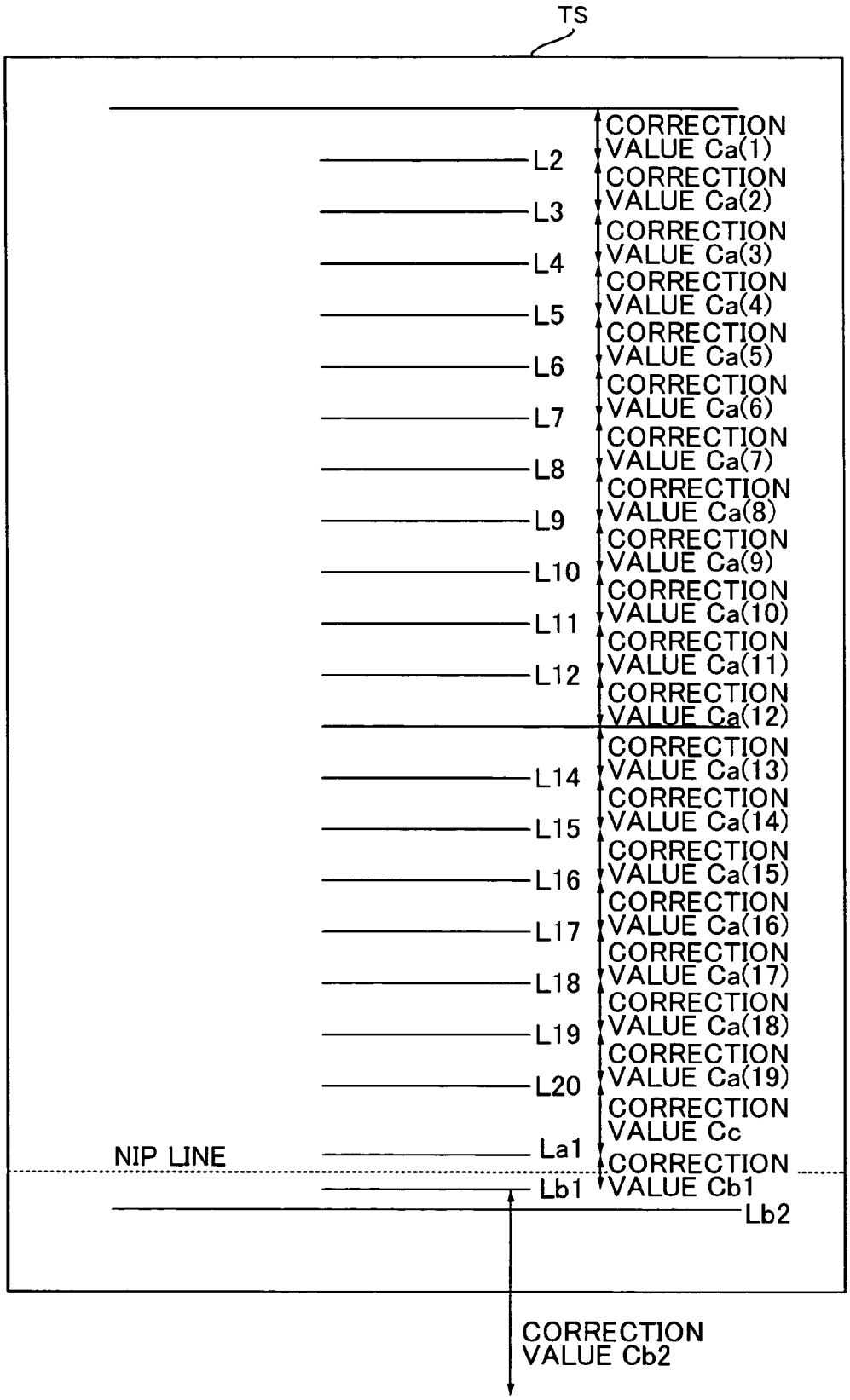
FIG. 23 is an explanatory diagram of a range associated with the correction values Ca(i), Cc, Cb1, and Cb2.

FIG. 23 is an explanatory diagram of a range associated with the correction values Ca(i), Cc, Cb1, and Cb2. FIG. 24 is an explanatory diagram of a table stored in the memory 63.

In the present embodiment, the correction values stored in the memory 63 are correction values Ca(1) to Ca(19) and Cc in the NIP state, the correction values Cb1 in the transition from the NIP state to the non NIP state, and the correction values Cb2 in the non NIP state. Furthermore, border position information for indicating the range to which each correction value is applied is also associated with each correction value and stored in the memory 63.

In the present embodiment, the border position information associated with the correction values Ca(i) is information that indicates a position (theoretical position) corresponding to the lines L(i+1) in the measurement pattern; this border position information indicates a lower end side border of the range to which the correction values Ca(i) are applied. It should be noted that the upper end side border can be obtained from the border position information associated with the correction values Ca(i−1). Accordingly, the applicable range of the correction value Ca(2) for example is a range between the position of the line L2 and the position of the line L3 with respect to the paper S (at which the nozzle #90 is positioned).

Similarly, in the present embodiment, the border position information associated with the correction values Cc is information that indicates a position (theoretical position) corresponding to the line La1 in the measurement pattern; this border position information indicates a lower end side border of the range to which the correction values Cc are applied. It should be noted that the upper end side border can be obtained from the border position information associated with the correction value Ca(20). Accordingly, the applicable range of the correction values Cc is a range between the position of the line L20 and the position of the line La1 with respect to the paper S (at which the nozzle #90 is positioned).

Furthermore, in the present embodiment, the border position information associated with the correction values Cb1 is information that indicates a position (theoretical position) corresponding to the line Lb1 in the measurement pattern; this border position information indicates a lower end side border of the range to which the correction values Cb1 are applied. It should be noted that the upper end side border can be obtained from the border position information associated with the correction value Cc. Accordingly, the applicable range of the correction values Cb1 is a range between the position of the line La1 and the position of the line Lb1 with respect to the paper S (at which the nozzle #90 is positioned).

It should be noted that in the case where the nozzle #90 is positioned on the lower end side from the line Lb1, it is not absolutely necessary to associate the border position information (lower end side border) to the correction value Cb2 since the correction value Cb2 is always applied.

At the printer manufacturing factory, a table reflecting the individual characteristics of each individual printer is stored in the memory 63 for each printer that is manufactured. Then, the printer in which this table has been stored is packaged and shipped.

Transport Operation during Printing by Users

When printing is carried out by a user who has purchased the printer, the controller 60 reads out the table from the memory 63 and corrects the target transport amounts based on the correction values, then carries out the transport operation based on the corrected target transport amount. The following is description concerning a manner of transport operations during printing by the user.

Figure 25:
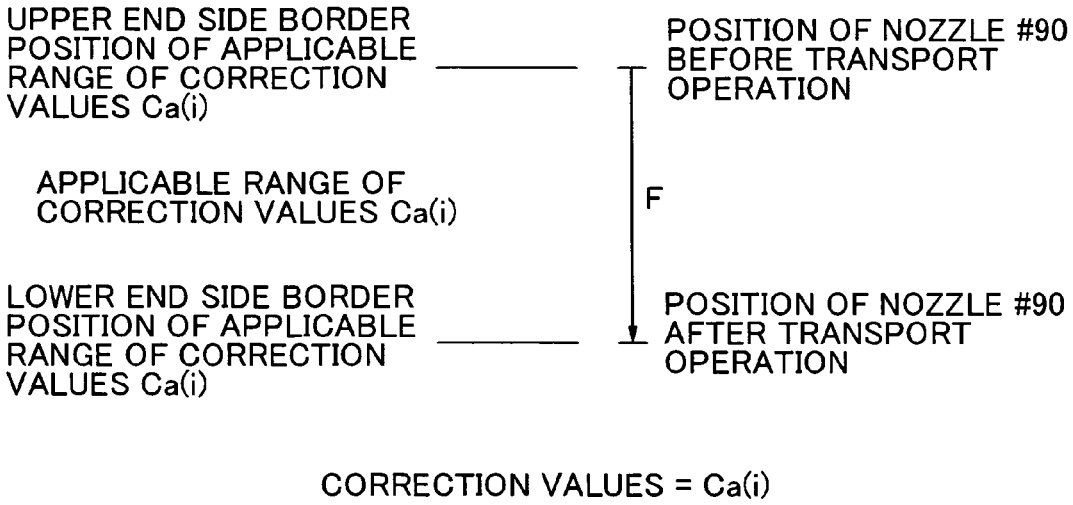
FIG. 25 is an explanatory diagram of correction values in a first case.
Figure 25:
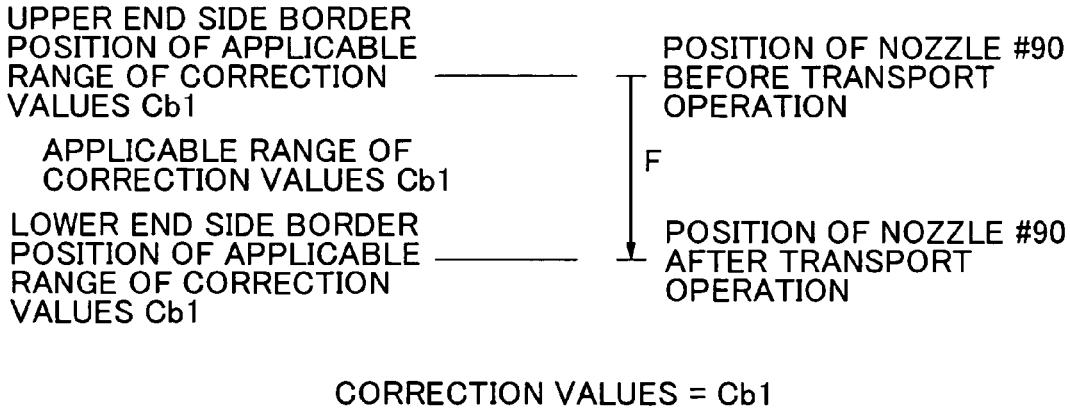

FIG. 25 is an explanatory diagram of correction values in a first case. As shown in the upper portion of FIG. 25, in the first case, the position of the nozzle #90 before the transport operation (the relative position with respect to the paper) matches the upper end side border position of the applicable range of the correction values Ca(i), and the position of the nozzle #90 after the transport operation matches the lower end side border position of the applicable range of the correction values Ca(i). In this case, the controller 60 sets the correction values to Ca(i), sets as a target a value obtained by adding the correction value Ca(i) to an initial target transport amount F, then drives the transport motor 22 to transport the paper.

Also, a same approach can be applied to the correction values Cb1, Cb2, and Cc. For example, as shown in the lower portion of FIG. 25, in the case where the position of the nozzle #90 before the transport operation (the relative position with respect to the paper) matches the upper end side border position of the applicable range of the correction values Cb1, and the position of the nozzle #90 after the transport operation matches the lower end side border position of the applicable range of the correction values Cb1, the controller 60 sets the correction values to Cb1, sets as a target a value obtained by adding the correction value Cb1 to an initial target transport amount F, then drives the transport motor 22 to transport the paper.

Figure 26:
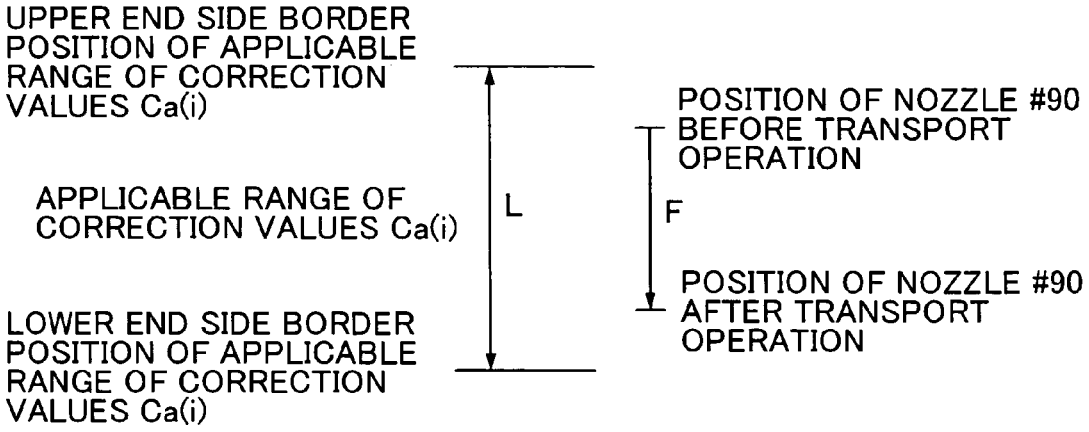
FIG. 26 is an explanatory diagram of correction values in a second case.
Figure 26:
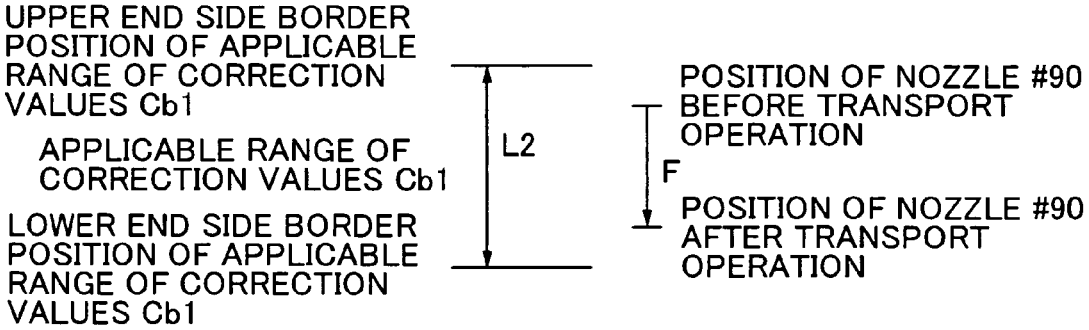

FIG. 26 is an explanatory diagram of correction values in a second case. As shown in the upper portion of FIG. 26, in the second case, the positions of the nozzle #90 before and after the transport operation are both within the applicable range of the correction values Ca(i). In this case, the controller 60 sets as a correction value a value obtained by multiplying a ratio F/L between the initial target transport amount F and a transport direction length L of the applicable range by Ca(i). Then, the controller 60 sets as a target a value obtained by adding the correction value Ca(i) multiplied by (F/L) to the initial target transport amount F, then drives the transport motor 22 to transport the paper.

Also, a same approach can be applied to the correction values Cb1, Cb2, and Cc. For example, as shown in the lower portion of FIG. 26, in the case where the positions of the nozzle #90 before and after the transport operation are both within the applicable range of the correction values Cb1, the controller 60 sets the correction values to Cb1×(F/L2), sets as a target a value obtained by adding the correction value Cb1×(F/L2) to an initial target transport amount F, then drives the transport motor 22 to transport the paper.

Figure 27:
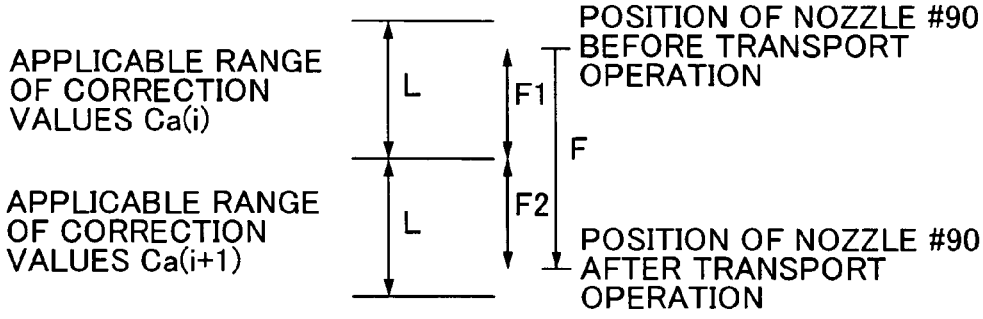
FIG. 27 is an explanatory diagram of correction values in a third case.
Figure 27:
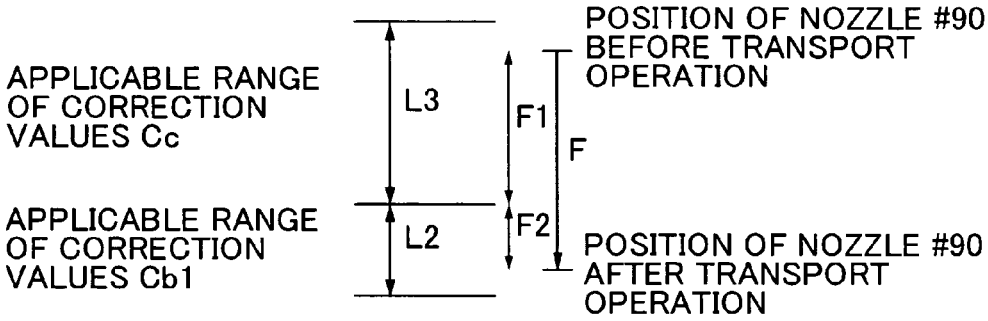
Figure 27:
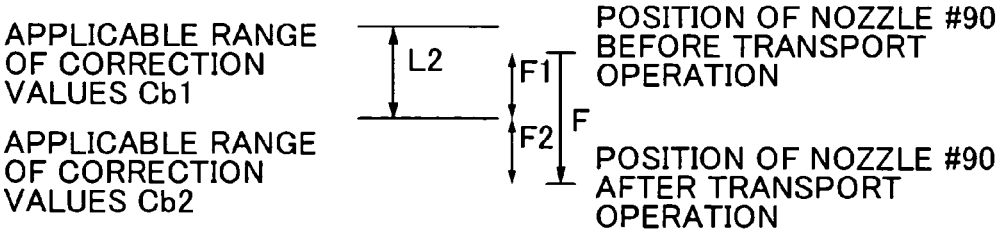

FIG. 27 is an explanatory diagram of correction values in a third case. As shown in the upper portion of FIG. 27, in the third case, the position of the nozzle #90 before the transport operation is within the applicable range of the correction values Ca(i), and the position of the nozzle #90 after the transport operation is within the applicable range of the correction values Ca(i+1). Here, of the target transport amounts F, the transport amount in the applicable range of the correction values Ca(i) is set as F1, and the transport amount in the applicable range of the correction values Ca(i+1) is set as F2. In this case, the controller 60 sets as the correction value a sum of a value obtained by multiplying Ca(i) by F1/L and a value obtained by multiplying Ca(i+1) by F2/L. Then, the controller 60 sets as a target a value obtained by adding the correction value Ca(i)×(F1/L)+Ca(i+1)×(F2/L) to the initial target transport amount F, then drives the transport motor 22 to transport the paper.

Also, a same approach can be applied to the correction values Cb1, Cb2, and Cc. For example, as shown in the middle portion of FIG. 27, in the case where the position of the nozzle #90 before the transport operation is within the applicable range of the correction values Cc, and the position of the nozzle #90 after the transport operation is within the applicable range of the correction values Cb1, the controller 60 sets the correction values to Cc×(F1/L3)+Cb1×(F2/L2), sets as a target a value obtained by adding the correction value Cc×(F1/L3)+Cb1×(F2/L2) to an initial target transport amount F, then drives the transport motor 22 to transport the paper.

Furthermore, as shown in the lower portion of FIG. 27, in the case where the position of the nozzle #90 before the transport operation is within the applicable range of the correction values Cb1, and the position of the nozzle #90 after the transport operation is within the applicable range of the correction values Cb2, the controller 60 sets the correction values to Cb1×(F1/L2)+Cb2×(F2/L4), sets as a target a value obtained by adding the correction value Cb1×(F1/L2)+Cb2×(F2/L4) to an initial target transport amount F, then drives the transport motor 22 to transport the paper. It should be noted that L4 is set to a theoretical transport amount for a transport operation carried out between the pass n and the pass n+1, namely, one inch.

Figure 28:
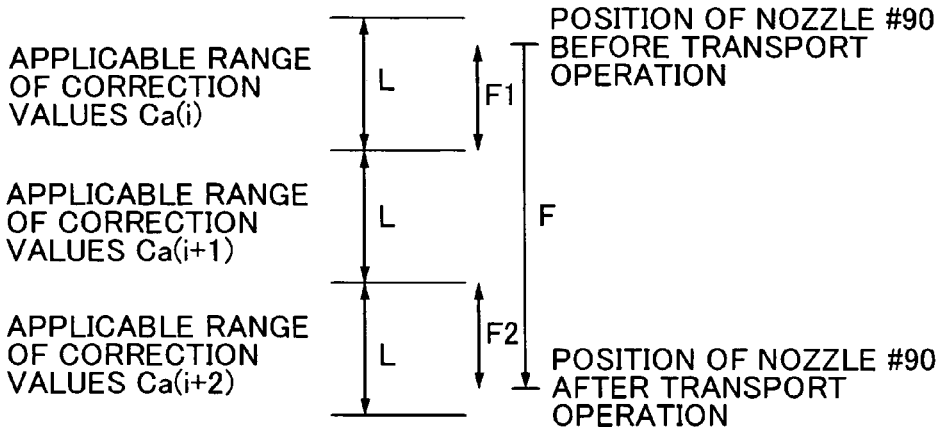
FIG. 28 is an explanatory diagram of correction values in a fourth case.
Figure 28:
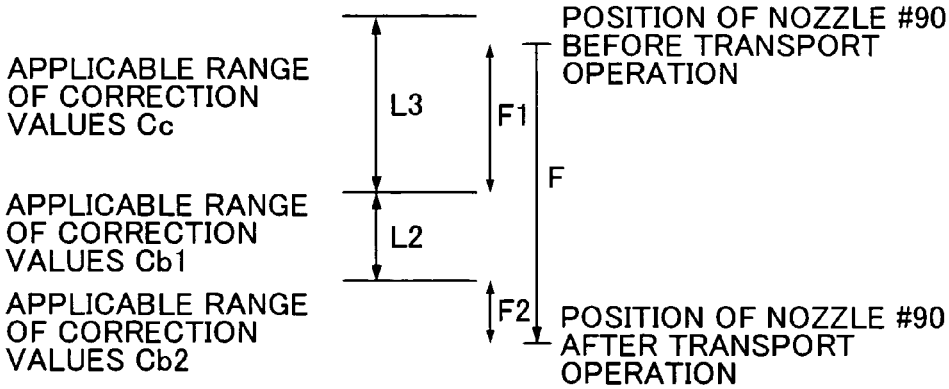

FIG. 28 is an explanatory diagram of correction values in a fourth case. As shown in the upper portion of FIG. 28, in the fourth case, the paper is transported so as to pass the applicable range of the correction values Ca(i+1). In this case, the controller 60 sets as the correction value a sum of a value obtained by multiplying Ca(i) by F1/L, Ca(i+1), and a value obtained by multiplying Ca(i+2) by F2/L. Then, the controller 60 sets as a target a value obtained by adding the correction value Ca(i)×(F1/L) +Ca(i+1)+Ca(i+2)×(F2/L) to the initial target transport amount F, then drives the transport motor 22 to transport the paper.

Also, a same approach can be applied to the correction values Cb1, Cb2, and Cc. For example, as shown in the lower portion of FIG. 28, in the case where the position of the nozzle #90 before the transport operation is within the applicable range of the correction values Cc, and the paper is transported so as to pass the applicable range of the correction values Cb1, the controller 60 sets the correction values to Cc×(F1/L3)+Cb1+Cb2×(F2/L4), sets as a target a value obtained by adding the correction value Cc×(F1/L3)+Cb1+Cb2×(F2/L4) to an initial target transport amount F, then drives the transport motor 22 to transport the paper. It should be noted that L4 is set to a theoretical transport amount for a transport operation carried out between the pass n and the pass n+1, namely, one inch.

In this manner, when the controller corrects the initial target transport amount F and controls the transport unit based on the corrected target transport amount, the actual transport amount is corrected so as to become the initial target transport amount F, and the transport error is corrected.

Other Embodiments

The foregoing embodiments described primarily a printer. However, it goes without saying that the foregoing description also includes the disclosure of printing apparatuses, recording apparatuses, liquid ejection apparatuses, transport methods, printing methods, recording methods, liquid ejection methods, printing systems, recording systems, computer systems, programs, storage media having a program stored thereon, display screens, screen display methods, and methods for producing printed material, for example.

Also, a printer, for example, serving as an embodiment was described above. However, the foregoing embodiment is for the purpose of elucidating the invention and is not to be interpreted as limiting the invention. The invention can of course be altered and improved without departing from the gist thereof and includes functional equivalents. In particular, embodiments described below are also included in the invention.

In the above embodiments a printer was described, however, there is no limitation to this. For example, the same technology as that of this embodiment can also be applied to various types of liquid ejecting apparatuses that employ inkjet technology, including color filter manufacturing apparatuses, dyeing apparatuses, micromachining apparatuses, semiconductor manufacturing apparatuses, surface treatment apparatuses, three-dimensional molding machines, vaporizers, organic EL manufacturing apparatuses (in particular, polymer EL manufacturing apparatuses), display manufacturing apparatuses, film formation apparatuses, and DNA chip manufacturing apparatuses.

Furthermore, there is no limitation to the use of piezo elements and, for example, application in thermal printers or the like is also possible.

Comprehensive Description (1) A printer according to the foregoing embodiments is provided with the head 41, the transport unit 20, the memory 63, and the controller 60. The transport unit 20 transports paper S in the transport direction with respect to the head 41 in accordance with the target transport amount.

In this regard, the controller 60 controls the transport unit 20 based on the target transport amount; but, in case where there is transport error, the actual transport amount do not match the target transport amount. Accordingly, the controller 60 corrects the target transport amount, controls the transport unit 20 based on the corrected target transport amount, thereby correcting the transport error in such a manner as the actual transport amount matches the target transport amount.

Here, due to the effect of paper friction and the like, the DC component transport error is a value that varies depending on the total transport amount of the paper (see the dashed line in FIG. 6). In other words, the DC component transport error is a value that varies depending on the relative positional relationship of the paper S and the head 41.

Accordingly, in the memory 63 according to the present embodiment are stored a plurality of correction values (see FIG. 24) respectively associated with the relative positions between the head and the paper S (more specifically, the relative position between the nozzle #90 and the paper S). Then, a range of the relative position to which each of the correction values is to be applied is associated with that correction value. For example, with the above-described correction values Ca(i), the range is associated in such a manner as a position (theoretical position) corresponding to the line Li of the measurement pattern is set as the upper end side border position of the applicable range and a position (theoretical position) corresponding to the line L(i+1) of the measurement pattern is set as the lower end side border position of the applicable range.

And when a transport is performed beyond the applicable range of the correction value that is associated with the relative position before the transport, the controller 60 corrects the target transport amount based on the correction value associated with the relative position before the transport and the correction value associated with the relative position after the transport. For example, as shown in the upper portion of FIG. 27, in the case where a transport is performed beyond the applicable range of the correction values Ca(i) that is associated with the relative position before the transport, the controller corrects the target transport amount based on the correction value Ca(i) associated with the relative position before the transport and the correction value Ca(i+1) associated with the relative position after the transport.

In this manner, the transport amounts can be corrected in a manner having few restrictions. In addition, the DC component transport error, which fluctuates in response to the relative positions between the paper S and the head 41, can be accurately corrected in response to the transport amounts.

(2) the plurality of correction values stored in the memory 63 includes the correction value Cb1 (that is, the correction value Cb1 for the transition from the NIP state to the non NIP state), which is a first correction value, the range of the relative position associated with the first correction value being a range in which the medium is transported by both the transport roller 23 and the discharge rollers 25 in the relative position that is at one end of the range, and the medium is transported by only the discharge rollers 25 of these two rollers in the relative positions that is at another end of the range.

And there is a case in which, when a transport using the target transport amount is performed, the correction value Cb1 is either one of the correction value associated with the relative position before the transport and the correction value associated with the relative position after the transport. For example (in the case of the former), as shown in the lower portion of FIG. 27, in the case where transport is performed beyond the applicable range of the correction value Cb1 that is associated with the relative position before the transport, the controller corrects the target transport amount based on the correction value Cb2 associated with the relative position before the transport and the correction value Cb1 associated with the relative position after the transport. Also for example (in the case of the latter), as shown in the middle portion of FIG. 27, in the case where a transport is performed beyond the applicable range of the correction value Cc that is associated with the relative position before the transport, the controller corrects the target transport amount based on the correction value Cc associated with the relative position before the transport and the correction value Cb1 associated with the relative position after the transport.

It is known that transport error becomes excessive at a moment when paper is being transported and a transition from the NIP state to the non NIP state is carried out (this is generally referred to as "fly out"). And in examples such as the lower portion of FIG. 27 and the middle portion of FIG. 27, transport error whose magnitude becomes larger due to the transition from the NIP state to the non NIP state can be corrected accurately in accordance with the transport amounts.

(3) The above-described controller 60 corrects the target transport amount by weighting to the correction value in accordance with a ratio of a range in which the relative position changes during transport to an applicable range of the correction values. For example, in a case such as that shown in FIG. 27, the controller 60 corrects the target transport amount by weighting to the correction value Ca(i) in accordance with a ratio F1/L, which is a ratio of a range Fl in which the relative position changes during transport to an applicable range L of the correction value, and by weighting the correction value Ca(i+1) in accordance with a ratio F2/L, which is a ratio of a range F2 in which the relative position changes during transport to the applicable range L of the correction value.

In this way, DC component transport error, which fluctuates in response to the relative position of the paper S and the head 41, can be accurately corrected in response to the transport amount.

(4) It should be noted that the description of the foregoing embodiments includes not only description of an inkjet printer, which is a liquid ejecting apparatus, but also description of a transport method for transporting a medium such as the paper S. And with the above-described transport method, the transport amount can be corrected in a manner having few restrictions, and the DC component transport error can be accurately corrected in response to the transport amount, the DC component transport error fluctuating in response to the relative position of the paper S and the head 41.

What is claimed is:

1. A liquid ejecting apparatus, comprising:

a head that ejects a liquid;

a transport mechanism that transports a medium in a transport direction with respect to the head in accordance with a target transport amount that is targeted;

a memory that stores a plurality of correction values, each of the correction values being associated with a relative position between the head and the medium, a range of the relative position to which that correction value is to be applied being associated with that correction value; and a controller that, in the case where a transport using the target transport amount is performed beyond the range of the relative position associated with the correction value that is associated with the relative position before the transport, corrects the target transport amount based on the correction value associated with the relative position before the transport and the correction value associated with the relative position after the transport.

2. A liquid ejecting apparatus according to claim 1, wherein the transport mechanism has an upstream side transport roller and a downstream side transport roller that transport the medium, these being arranged on an upstream side and a downstream side respectively in the transport direction, the plurality of correction values includes a first correction value, the range of the relative position associated with the first correction value being a range in which the medium is transported by both the upstream side transport roller and the downstream side transport roller in the relative position that is at one end of the range, and the medium is transported by only the downstream side transport roller of these two rollers in the relative position that is at another end of the range, and in the case where a transport using the target transport amount is performed, the first correction value is either one of the correction value associated with the relative position before the transport and the correction value associated with the relative position after the transport.

3. A liquid ejecting apparatus according to claim 1, wherein the controller corrects the target transport amount by weighting to the correction value in accordance with a ratio of a range in which the relative position changes while transporting using the target transport amount to the range of the relative position to which the correction value is to be applied.

4. A transport method, in which a target transport amount that is targeted is corrected based on correction values to transport a medium, comprising:

storing in a memory in advance a plurality of correction values, each of the correction values being associated with a relative position between a head that ejects a liquid and the medium, in which a range of the relative position to which that correction value is to be applied is associated with that correction value;

in the case where a transport using the target transport amount is performed beyond the range of the relative position associated with the correction value that is associated with the relative position before the transport, correcting the target transport amount based on the correction value associated with the relative position before the transport and the correction value associated with the relative position after the transport; and transporting the medium based on the corrected target transport amount.

* * * * *